US007287652B2

(12) United States Patent
Scholen et al.

(10) Patent No.: US 7,287,652 B2
(45) Date of Patent: Oct. 30, 2007

(54) CONFIGURABLE DISPLAY SYSTEM AND MODULAR DISPLAY ARRANGEMENT FOR CONSUMER ELECTRONIC DEVICES

(75) Inventors: Jonah M. Scholen, Minneapolis, MN (US); Blake Nielsen, Schaumberg, IL (US); Raul S. Romerio, Ajax (CA); Aaron Guiden, Fraserville (CA)

(73) Assignee: Target Brands, Inc., Minneapolis, MN (US)

( * ) Notice: Subject to any disclaimer, the term of this patent is extended or adjusted under 35 U.S.C. 154(b) by 383 days.

(21) Appl. No.: 11/084,676

(22) Filed: Mar. 18, 2005

(65) Prior Publication Data

US 2005/0247649 A1 Nov. 10, 2005

Related U.S. Application Data

(60) Provisional application No. 60/554,609, filed on Mar. 19, 2004.

(51) Int. Cl.
*A47F 7/00* (2006.01)

(52) U.S. Cl. ..... 211/26; 340/568.2

(58) Field of Classification Search ..... 211/26, 211/26.2, 60.1, 69.1, 162, 195
See application file for complete search history.

(56) References Cited

U.S. PATENT DOCUMENTS

| | | | | |
|---|---|---|---|---|
| 665,800 | A | | 1/1901 | Reno |
| 1,739,730 | A | | 12/1929 | Orthwine |
| 3,688,707 | A | | 9/1972 | White |
| 4,540,222 | A | | 9/1985 | Burrell |
| 5,124,685 | A | | 6/1992 | Rankin |
| 5,146,205 | A | | 9/1992 | Keifer et al. |
| 5,183,163 | A | | 2/1993 | Slaiken |
| 5,341,124 | A | | 8/1994 | Leyden et al. |
| 5,464,105 | A | * | 11/1995 | Mandeltort ..... 211/184 |
| 5,685,436 | A | | 11/1997 | Davet |
| 5,861,807 | A | | 1/1999 | Leyden et al. |
| 6,027,277 | A | | 2/2000 | Leyden et al. |
| 6,039,496 | A | | 3/2000 | Bishop |
| 6,039,498 | A | | 3/2000 | Leyden et al. |
| 6,087,939 | A | | 7/2000 | Leyden et al. |

(Continued)

OTHER PUBLICATIONS

Product Manual, Freedom Digital Camera Display Version 1.5 Universal Power, Jul. 2003.

(Continued)

*Primary Examiner*—George B. Nguyen
*Assistant Examiner*—Jeremy C Ramsey
(74) *Attorney, Agent, or Firm*—Dicke, Billig & Czaja, PLLC

(57) ABSTRACT

A method of displaying consumer electronic devices comprises supporting a plurality of rails on a frame in a generally parallel, spaced relationship and configuring each rail for slidable movement relative to the frame in a direction generally perpendicular to a longitudinal axis of each rail. A first row of display units is supported between a first adjacent pair of the rails and a second row of display units between a second adjacent pair of the rails, with each display unit comprising at least one of a device support unit and a plate. The plurality of display units are reconfigurable by exchanging the display units between different lateral positions within at least one of the first and second rows of display units and/or by exchanging at least one display unit between the first row and the second row of display units.

19 Claims, 28 Drawing Sheets

U.S. PATENT DOCUMENTS

| | | | | |
|---|---|---|---|---|
| 6,161,708 | A | 12/2000 | Myler | |
| 6,236,435 | B1 | 5/2001 | Gertz | |
| 6,283,278 | B1 * | 9/2001 | Holztrager | 206/6.1 |
| 6,476,717 | B1 | 11/2002 | Gross et al. | |
| 6,516,958 | B2 | 2/2003 | Tyski | |
| 6,601,929 | B2 | 8/2003 | Marihugh | |
| 6,698,597 | B2 | 3/2004 | Marihugh | |
| 6,946,961 | B2 * | 9/2005 | Frederiksen et al. | 340/568.2 |
| 2002/0166275 | A1 * | 11/2002 | Broadwell et al. | 40/606 |

OTHER PUBLICATIONS

Installation Manual, Freedom Version 1.1 Video Switching, Aug. 2003.

Installation Manual, Freedom Version 1.5 Universal Power, Aug. 2003.

Product Manual, Freedom Camcorder Display Version 1.1 Video Switching, Aug. 2003.

* cited by examiner

CONFIGURABLE DISPLAY SYSTEM AND MODULAR DISPLAY ARRANGEMENT FOR CONSUMER ELECTRONIC DEVICES

CROSS-REFERENCE TO RELATED APPLICATION

This patent application claims the benefit of the filing date of Provisional U.S. patent application Ser. No. 60/554,609, entitled "CONFIGURABLE DISPLAY SYSTEM AND MODULAR DISPLAY ARRANGEMENT FOR CONSUMER ELECTRONIC DEVICES," having filing date of Mar. 19, 2004, which is incorporated herein by reference.

The subject matter of this application is related to the subject matter of commonly assigned, pending U.S. Design patent application Ser. No. 29/201,783 (filed on Mar. 19, 2004), which is incorporated herein by reference.

BACKGROUND

Conventional displays of premium consumer products in a retail store typically include a cabinet with a large glass enclosure to house the products. Consumers interested in examining a product must ask a store clerk to assist them by opening the glass cabinet and letting the consumer look at and handle the product. Unfortunately, many consumers shy away from asking for help, and many times would prefer to look on their own without the direct assistance of a store clerk. Accordingly, retail stores can lose sales if demonstration models of the products are not readily accessible by the consumer. At the same time, the retail stores must safeguard their demonstration products from theft, vandalism, accidents, and shoplifters.

Given these challenges, retail marketers have responded by placing demonstration products on shelves that are accessible by consumers but then tethering the demonstration products with cables, retractable cords, and various security devices to prevent theft or accidental damage. Moreover, retailer marketers continue attempts to make shelving and product displays ever more attractive to consumers.

Despite all of this activity aimed at luring consumers, retailers continue to struggle in finding an optimal combination of function and flexibility in making products easily accessible for inspection while maintaining the security of those products at the point of display.

SUMMARY

One aspect of the invention is directed to a method of displaying consumer electronic devices. The method comprises supporting a plurality of rails on a frame in a generally parallel, spaced relationship and configuring each rail for slidable movement relative to the frame in a direction generally perpendicular to a longitudinal axis of each rail. A first row of display units is supported between a first adjacent pair of the rails and a second row of display units between a second adjacent pair of the rails, with each display unit comprising at least one of a device support unit and a plate. The plurality of display units are reconfigurable by exchanging the display units between different lateral positions within at least one of the first and second rows of display units and/or by exchanging at least one display unit between the first row and the second row of display units.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. All such variations are within the scope of the present invention.

Figure 1:
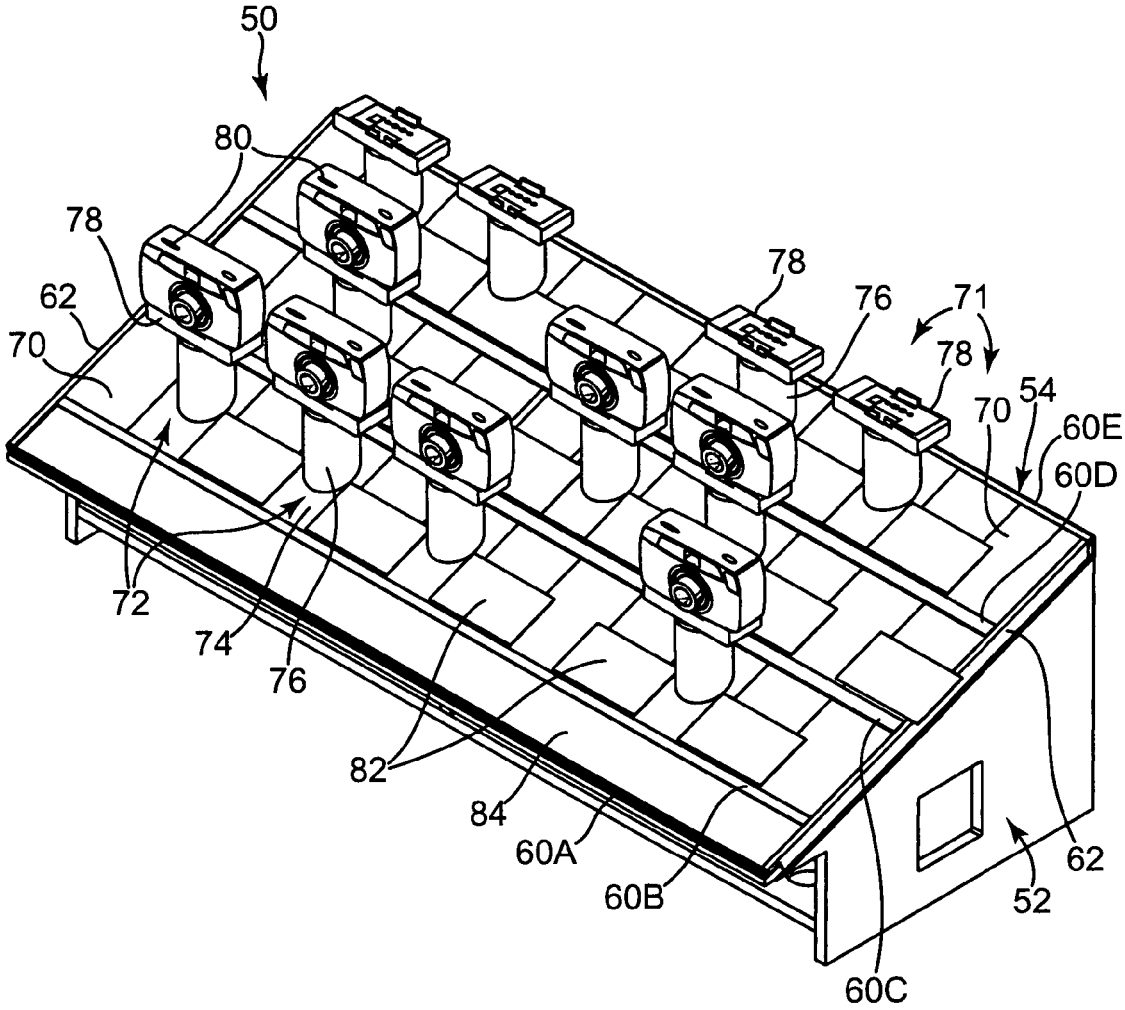
FIG. 1 is a perspective view of a display system, according to an embodiment of the present invention.

FIG. 1 is an isometric view illustrating one embodiment of display system 50. As shown in FIG. 1, configurable display system 50 comprises base 52, frame assembly 54, rails 60A, 60B, 60C, 60D, 60E, and side members 62. Display system 50 also comprises a plurality of display units 71. Display units 71 are in the form of a plurality of generally flat plates 70, and in the form of a plurality of device support units 72. Each device support unit 72 comprises plate 74, post 76, and bracket 78. Display system 50 also comprises display board 84 and sign units 82. Bracket 78 is configured to removably secure camera 80 or other handheld consumer electronics device, or other product, to device support unit 72. Sign units 82 and/or plates 70 may support price labels, product information, advertising, or the like. Plates 70 and plates 72 are generally identical in shape and form, according to embodiments of the invention.

Figure 2:
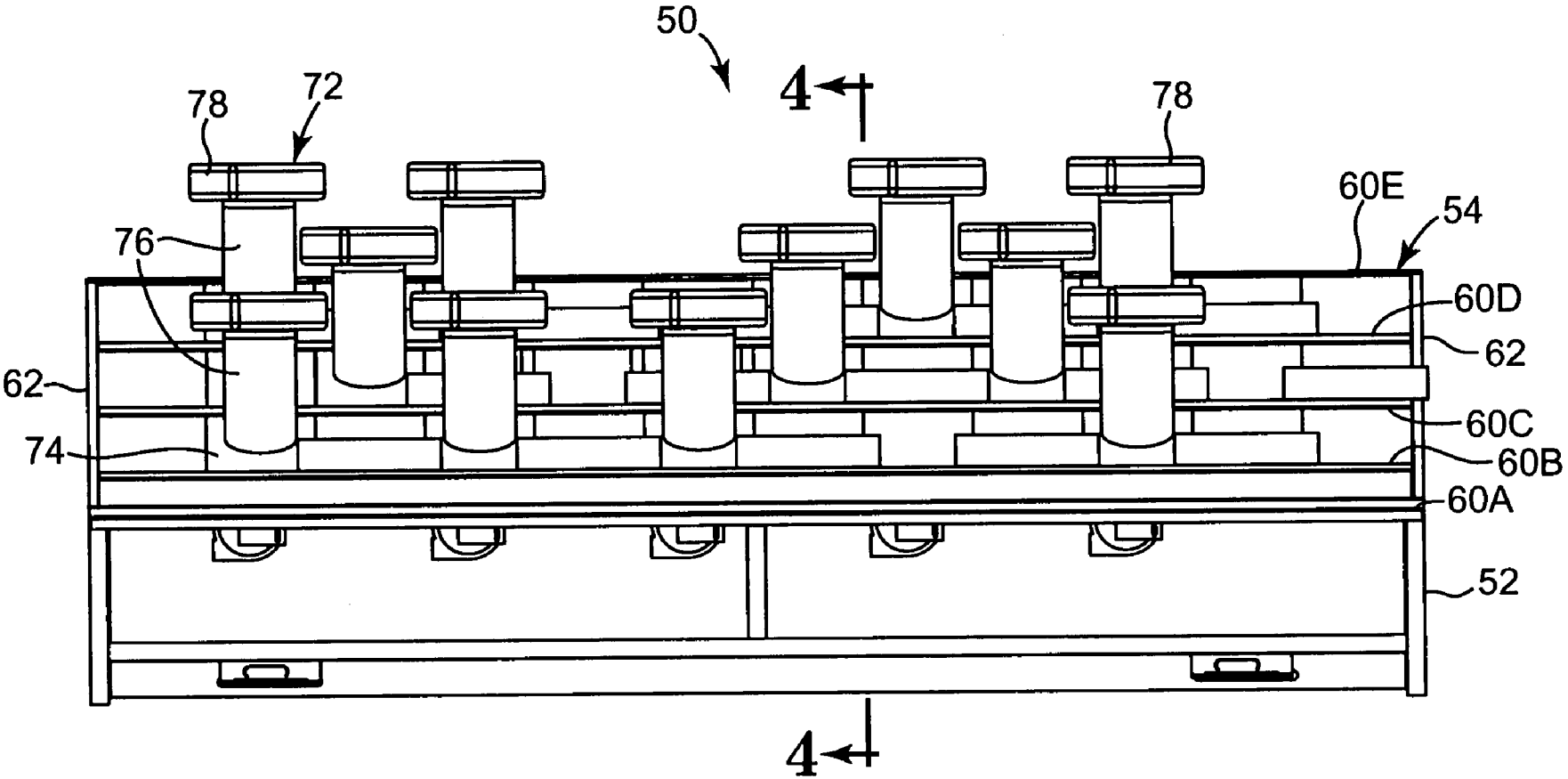
FIG. 2 is a front plan view of a display system, according to an embodiment of the present invention.

FIG. 2 is a front elevation view of display system 50, depicting corresponding components of system 50 shown in FIG. 1.

Figure 3:
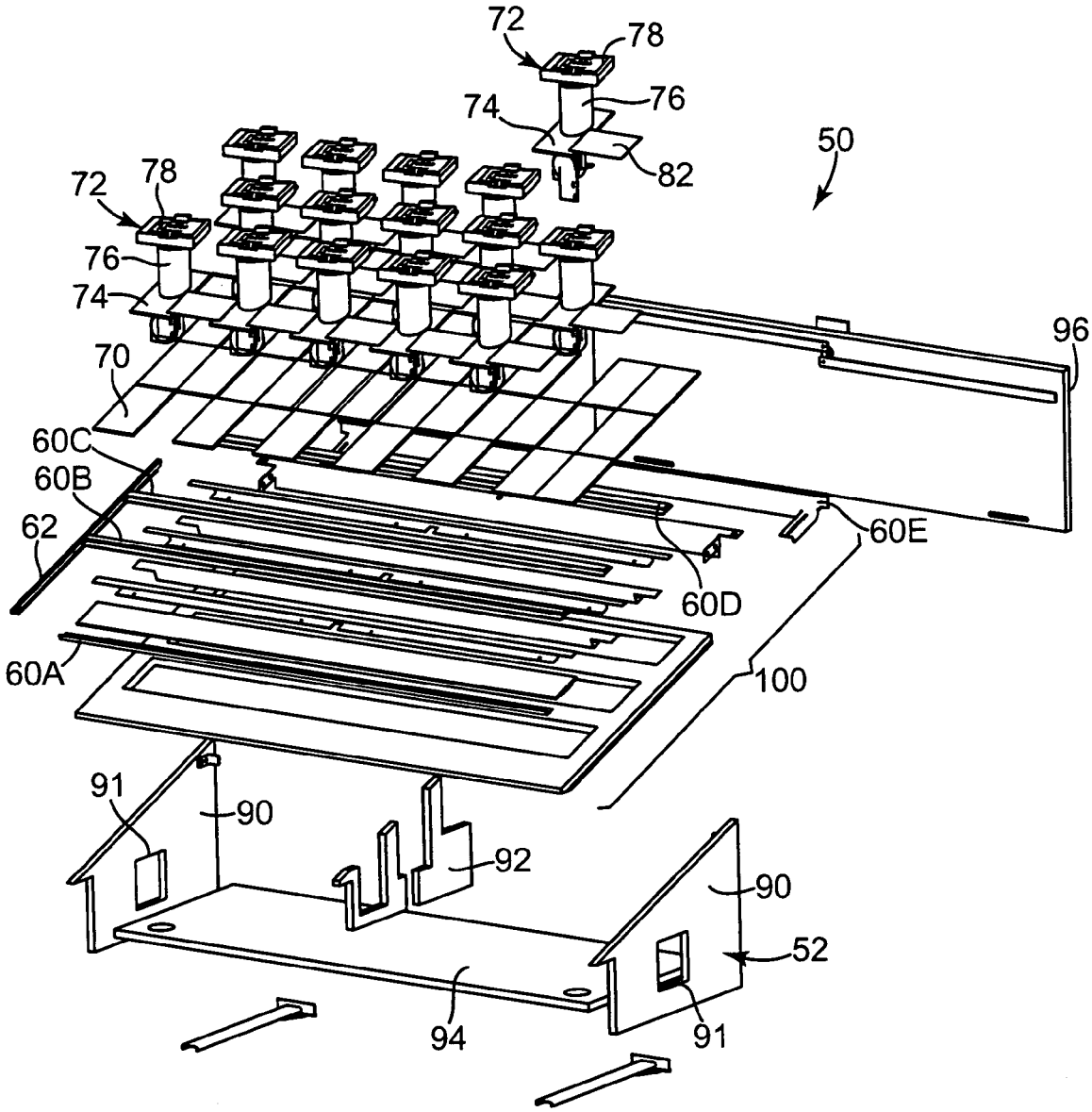
FIG. 3 is an exploded view of a display system, according to an embodiment of the present invention.

FIG. 3 is an exploded view of display system 50 illustrated in FIG. 1. As shown in FIG. 3, base 52 comprises vertical supports 90 with aperture 91, central support 92, bottom support 94, and rear support 96.

Base 52 supports frame assembly 100, which, in turn, supports the remaining components of display system 50, including plates 70 and device support units 72, and rails 60A-60B. Frame assembly 100 comprises a plurality of components that are described in detail in association with FIGS. 5-16C.

Figure 4:
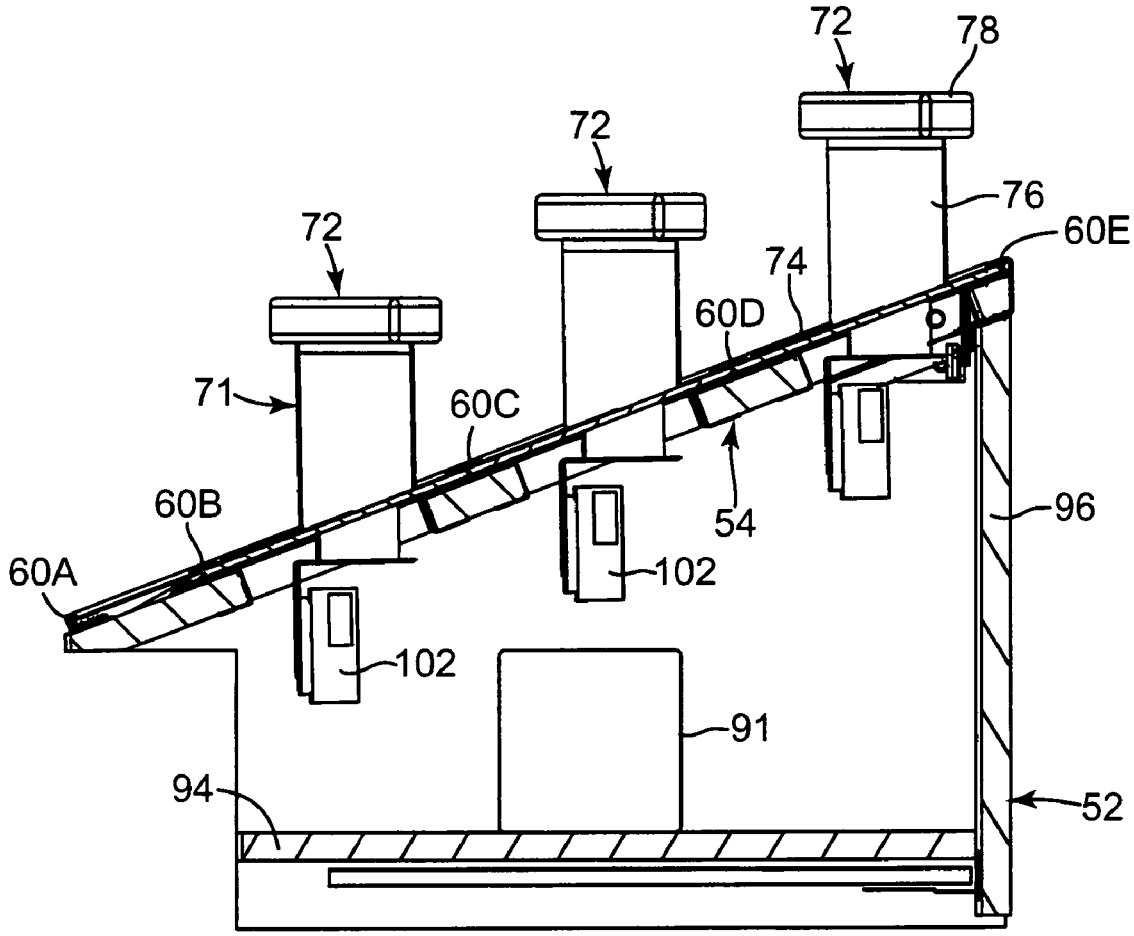
FIG. 4 is a side sectional view of the display system of FIG. 2, as taken along lines 4-4, according to an embodiment of the present invention.

FIG. 4 is a sectional view of display system 50 of FIG. 1. As shown in FIG. 4, base 52 supports frame 54, which in turn supports rails 60A-60E and display units 71. Device support unit 72 further comprises retractable cord unit 102 configured to secure camera 80 (FIG. 1) or other product to device support unit 72 via a retractable cord, which tethers camera 80 to display system 50. This tethering mechanism permits a user to pick up a camera for inspection while still securing camera 80 relative to display system 52. Device support unit 72 is illustrated and described in more detail in association with FIGS. 20-21.

Figure 5:
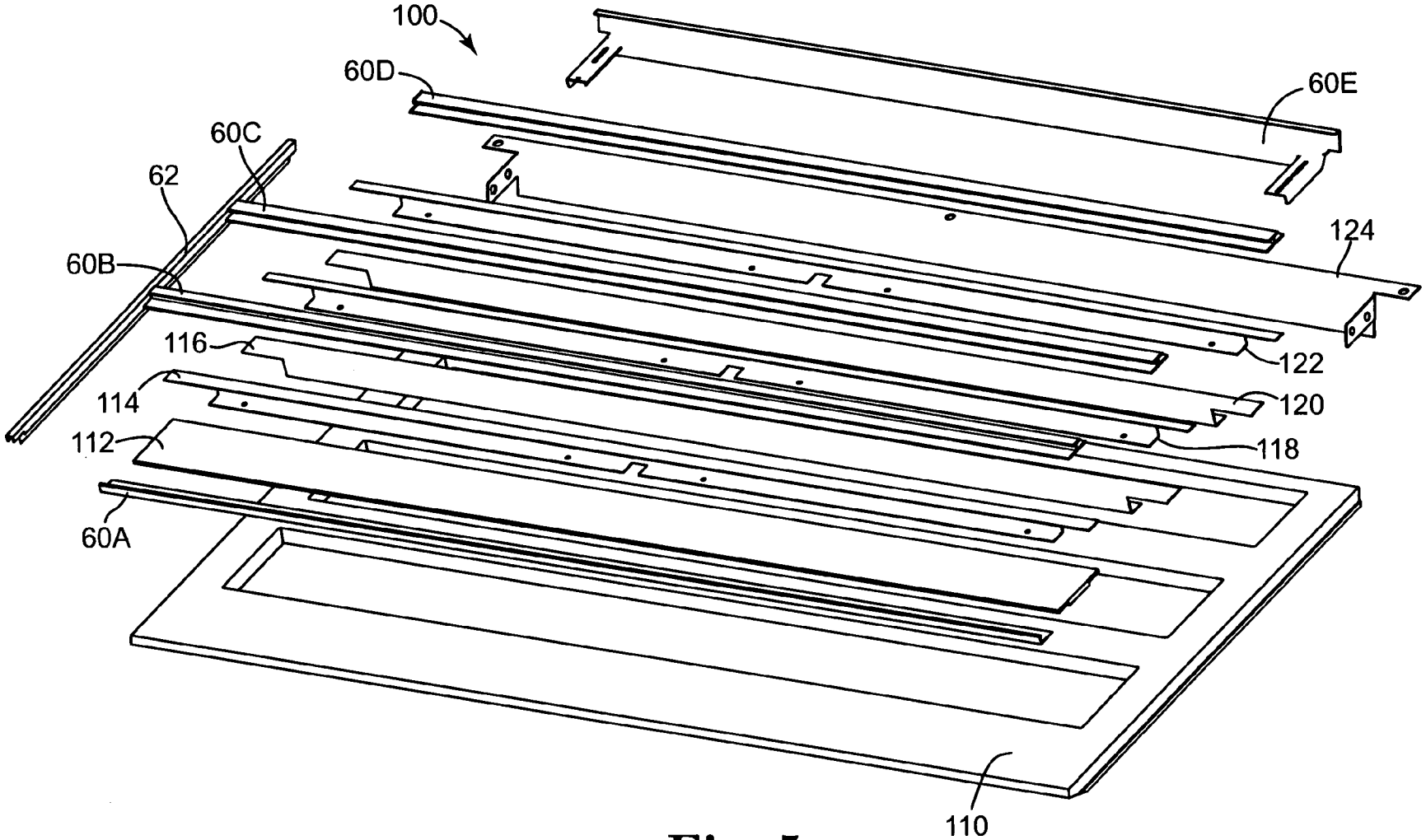
FIG. 5 is an exploded isometric view of a frame assembly and rails of of a display system, according to an embodiment of the present invention.

FIG. 5 is an enlarged exploded view of one embodiment of frame assembly 100 and rails 60A-60E. Frame assembly 100 includes a plurality of components that act together to support rails 60A-60E and direct their movement relative to one another. As shown in FIG. 5, frame assembly 100 comprises frame base 110, display board 112, first bracket stop 114, second bracket stop 116, third bracket stop 118, fourth bracket stop 120, fifth bracket stop 122, and vertical support 124. Rails 60B-60E are described in more detail in association with FIGS. 7A-7B and 10A-10C. Each of the components of frame assembly 100 is described in more detail in association with FIGS. 6, 8-9, and 11A-16C.

Figure 6:
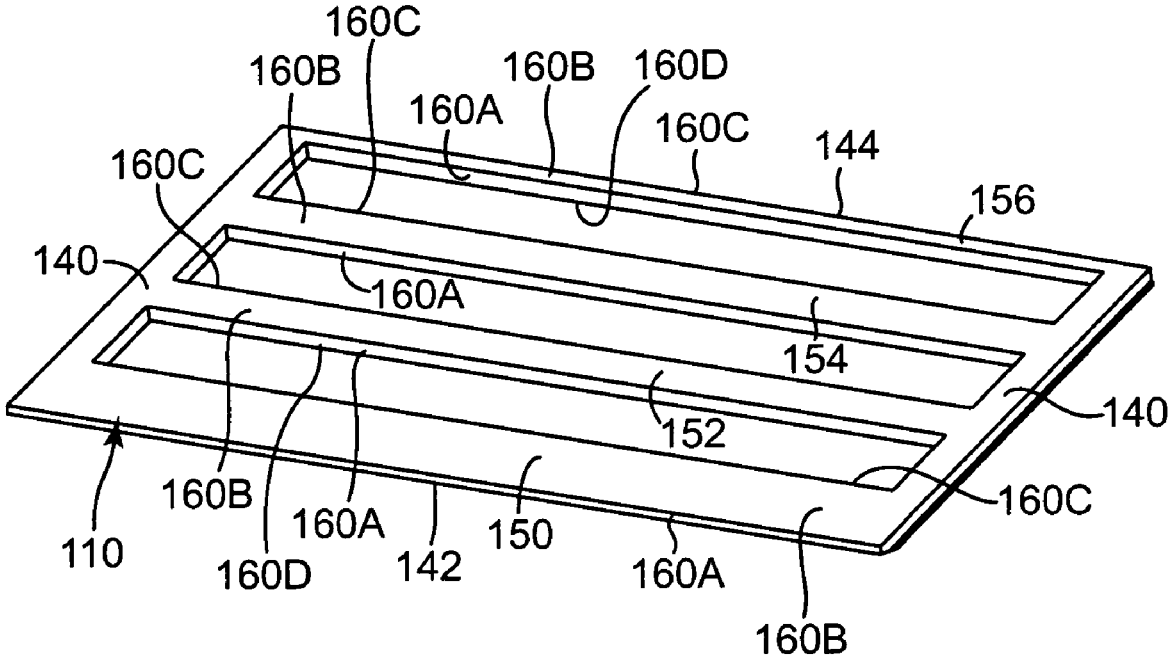
FIG. 6 is an isometric view of a base frame of a frame assembly of a display system, according to an embodiment of the present invention.

FIG. 6 is an isometric view of one embodiment of frame base 110. As shown in FIG. 6, frame base 110 comprises sides 140, front end 142, back end 144, and lateral members 150, 152, 154, 156, which extend laterally between sides 140 in a generally parallel spaced relationship. Each member 150, 152, 154, 156 comprises front 160A, top 160B, back 160C, and bottom 160D. Frame base 110 is made of a generally rigid material, such as a wood, metal or plastic material. Frame base 110 is securable onto base 52 (FIG. 3) and supports substantially all other components of frame assembly 100.

Figure 7A:
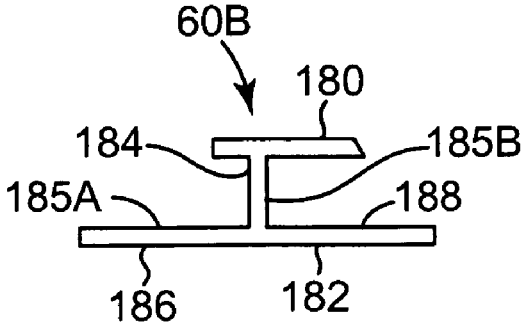
FIG. 7A is an end view of a rail of a display system, according to an embodiment of the present invention.

FIG. 7A is an end view of second rail 60B. As shown in FIG. 7A, second rail 60B comprises upper portion 180, lower portion 182, and central portion 184, which together define first channel 185A and second channel 185B. Lower portion 182 comprises first wing 186 and second wing 188.

Figure 7B:
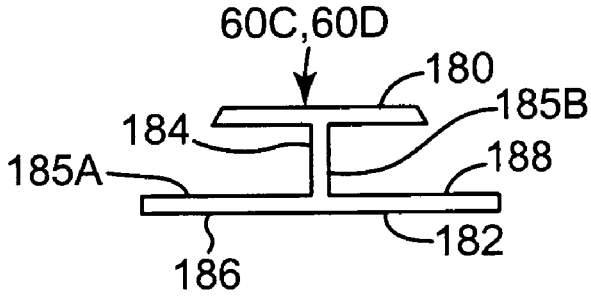
FIG. 7B is an end view of a rail of a display system, according to an embodiment of the present invention.

FIG. 7B is an end view of third and fourth rails 60C, 60D. As shown in FIG. 7B, third and fourth rails 60C have substantially the same features and attributes as corresponding elements of second rail 60B of the embodiment of FIG. 7A, except having a slightly longer upper portion 180 which defines a slightly deeper first channel 185A.

Figure 8:
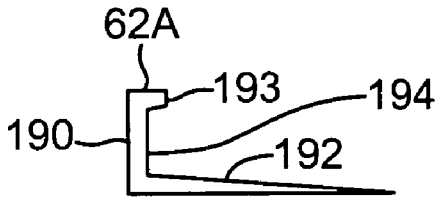
FIG. 8 is an end view of a side member of a frame assembly of a display system, according to an embodiment of the present invention.
Figure 9:
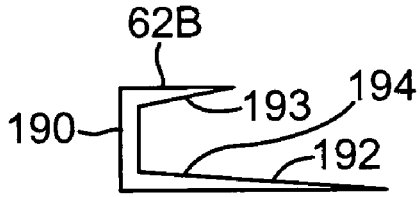
FIG. 9 is an end view of a side member of a frame assembly of a display system, according to an embodiment of the present invention.

FIGS. 8 and 9 are end views of side members 62A, 62B corresponding to side members 62 and/or of rail 60A or other components illustrated in or associated with FIG. 3. Side members 62A, 62B each comprise central portion 190, lower portion 192, and upper portion 193, which together define channel 194.

Figure 10A:
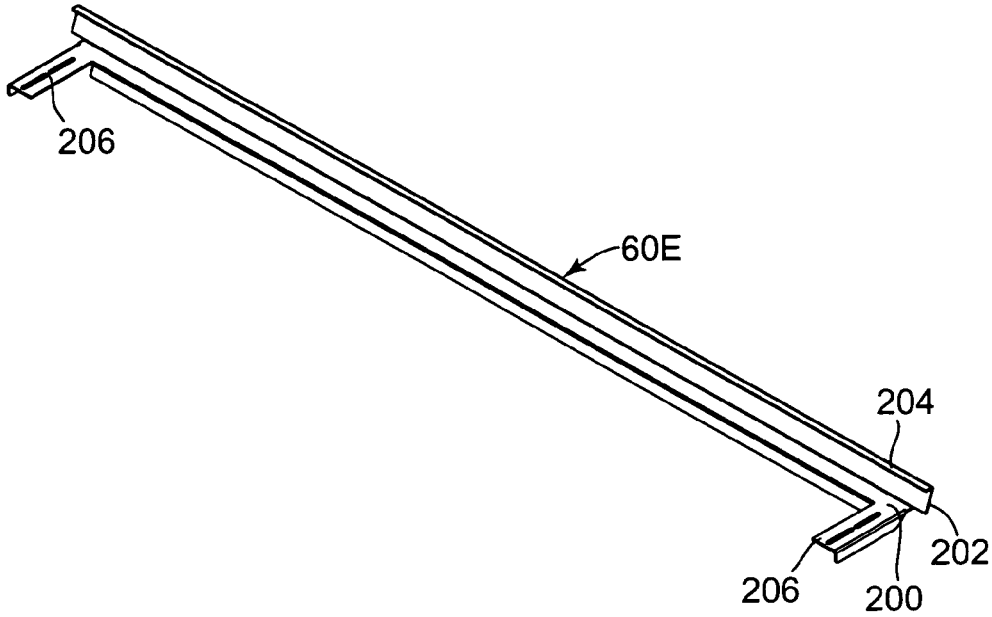
FIG. 10A is an isometric view of a rail of a display system, according to an embodiment of the present invention.
Figure 10B:
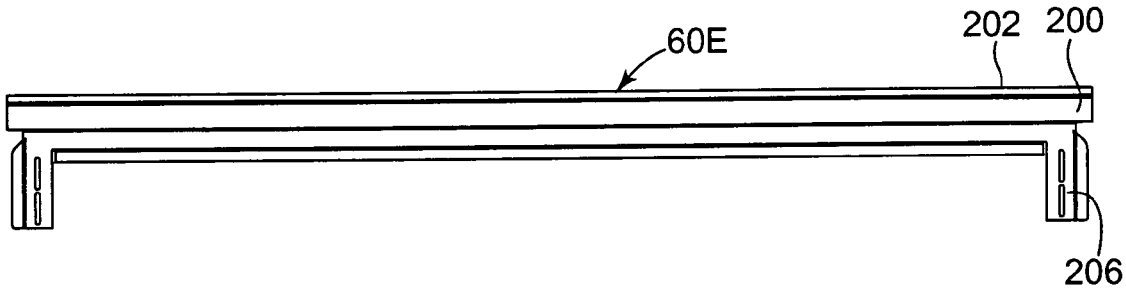
FIG. 10B is a plan view of a rail of a display system, according to an embodiment of the present invention.
Figure 10C:
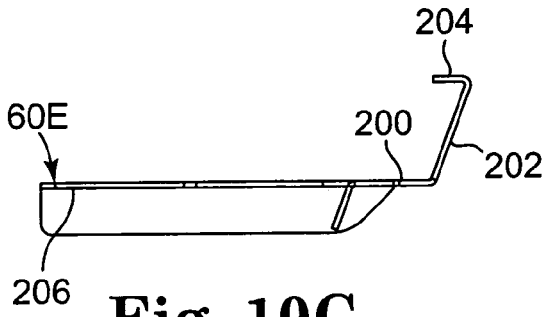
FIG. 10C is an end view of a rail of a display system, according to an embodiment of the present invention.

FIGS. 10A-10C are isometric, plan, and end views, respectively, of fifth rail 60E. As shown in FIGS. 10A-10C, fifth rail comprises lower portion 200, central portion 202 and upper lip portion 204. Apertured tabs 206 at opposite ends of fifth rail 60E extend outwardly from lower portion 200 for securing fifth rail 60E to member 156 of base frame 110.

Figure 11A:
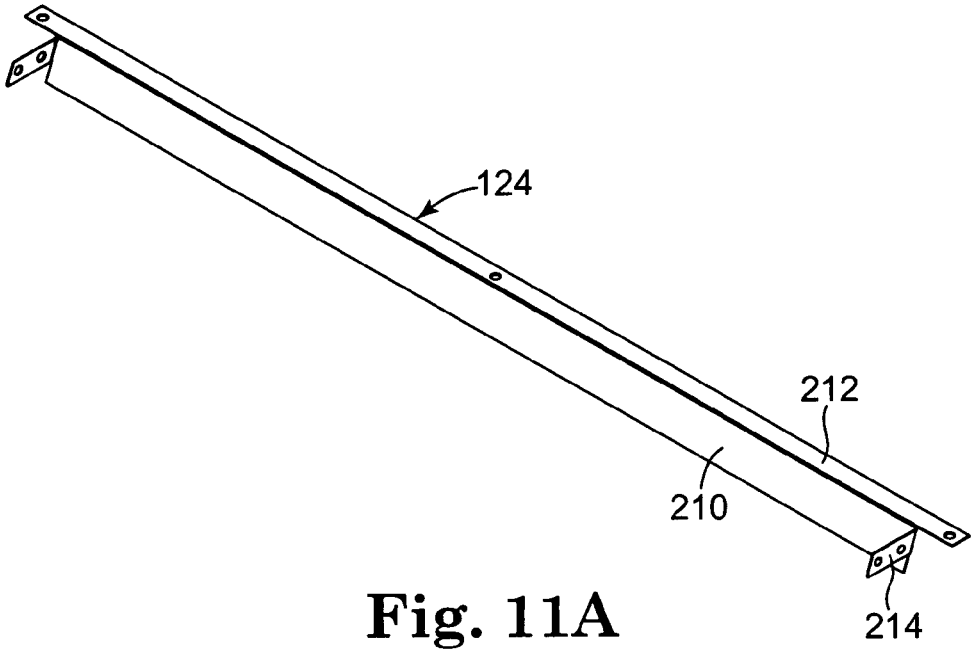
FIG. 11A is an isometric view of a vertical support of a frame assembly of a display system, according to an embodiment of the present invention.
Figure 11B:
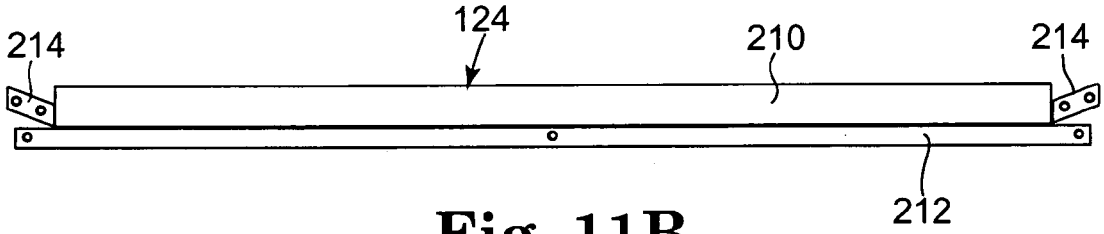
FIG. 11B is a plan view of a vertical support of a frame assembly of a display system, according to an embodiment of the present invention.
Figure 11C:
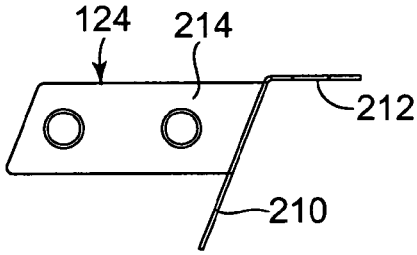
FIG. 11C is an end view of a vertical support of a frame assembly of a display system, according to an embodiment of the present invention.

FIGS. 11A-11C are isometric, plan, and end views, respectively, of vertical support 124. As shown in FIGS. 11A-11C, vertical support 124 comprises first portion 210 and second portion 212. Apertured tabs 206 at opposite ends of vertical support 124 extend outwardly from lower portion 200 for securing vertical support 124 to member 156 of base frame 110.

Figure 12A:
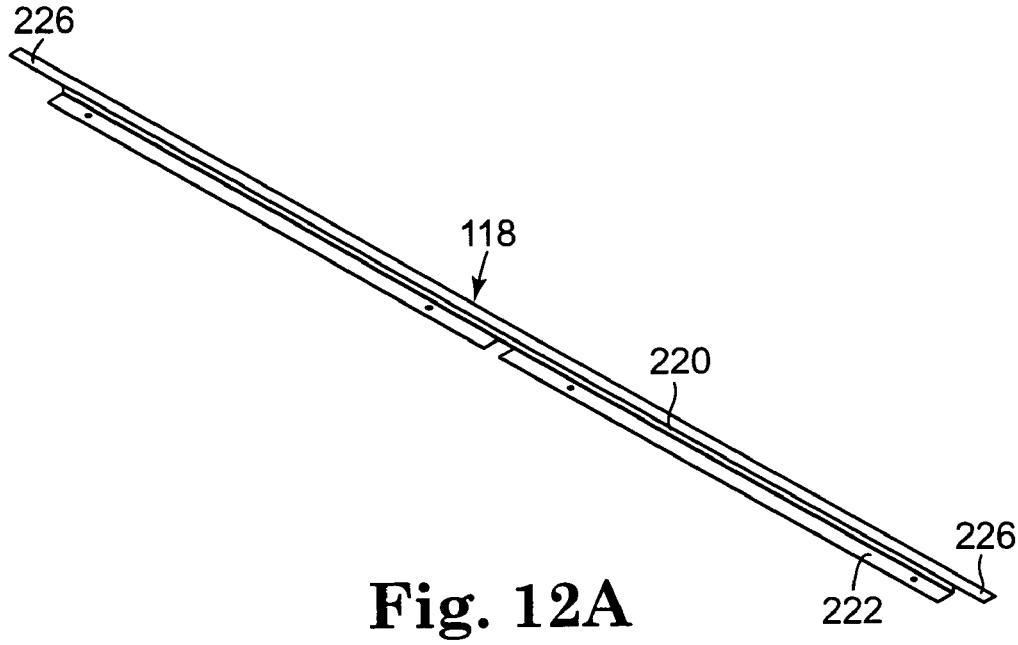
FIG. 12A is an isometric view of a bracket stop of a frame assembly of a display system, according to an embodiment of the present invention.
Figure 12B:
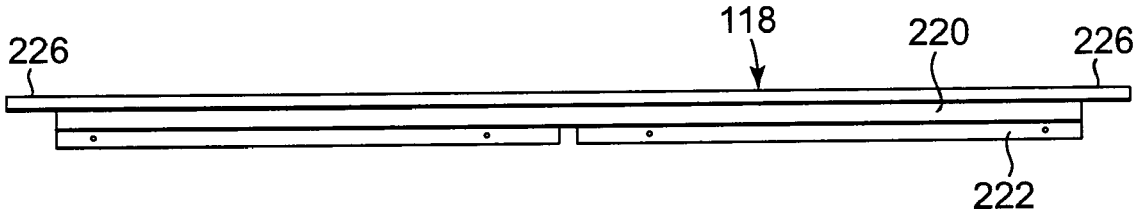
FIG. 12B is a plan view of a bracket stop of a frame assembly of a display system, according to an embodiment of the present invention.
Figure 12C:
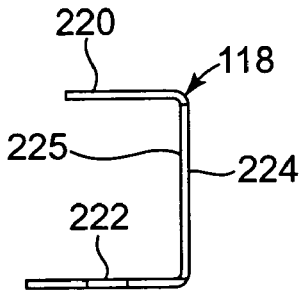
FIG. 12C is an end view of a bracket stop of a frame assembly of a display system, according to an embodiment of the present invention.

FIGS. 12A-12C are isometric, plan, and end views, respectively, of third bracket stop 118. As shown in FIGS. 12A-12C, third bracket stop 118 comprises upper portion 220, apertured lower portion 222, and central portion 224, which together define channel 225. In one embodiment, upper portion 220 comprises end portions 226 which extend laterally outward at opposite ends of third bracket stop 118 for insertion into and slidable movement within side members 62 of frame assembly 100 (FIG. 5). Apertures within lower portion 222 enable securing third bracket stop 118 to member 152 of base frame 110, which is shown in more detail in association with FIG. 18.

Figure 13A:
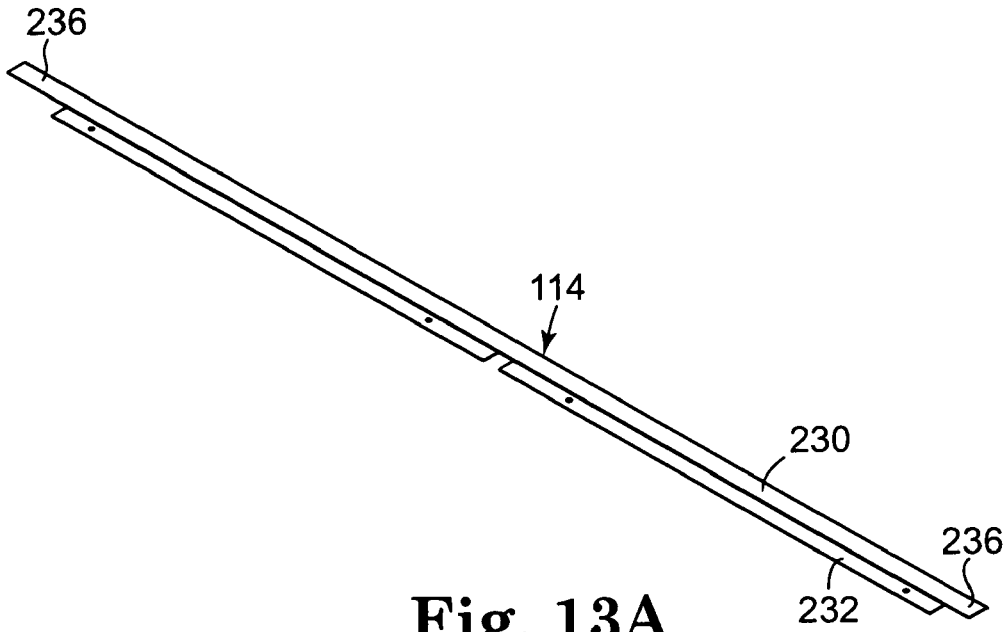
FIG. 13A is an isometric view of a bracket stop of a frame assembly of a display system, according to an embodiment of the present invention.
Figure 13B:
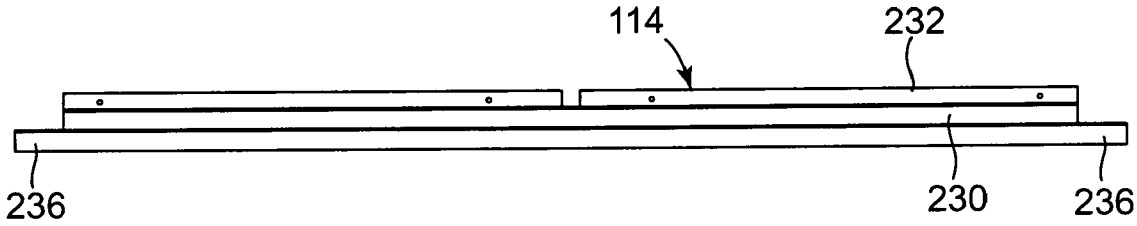
FIG. 13B is a plan view of a bracket stop of a frame assembly of a display system, according to an embodiment of the present invention.
Figure 13C:
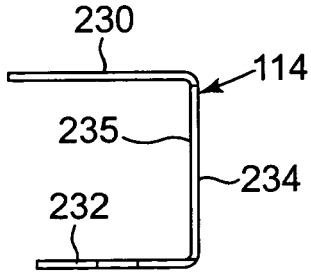
FIG. 13C is an end view of a bracket stop of a frame assembly of a display system, according to an embodiment of the present invention.

FIGS. 13A-13C are isometric, plan, and end views, respectively, of first bracket stop 114. As shown in FIGS. 13A-13C, first bracket stop 114 comprises upper portion 230, apertured lower portion 232, and central portion 234, which together define channel 235. In one embodiment, upper portion 230 comprises end portions 236 which extend laterally outward at opposite ends of first bracket stop 114 for insertion into and slidable movement within side members 62 of frame assembly 100 (FIG. 5). Apertures within lower portion 232 enable securing first bracket stop 118 to member 150 of base frame 110, which is shown in more detail in association with FIG. 18.

Figure 14A:
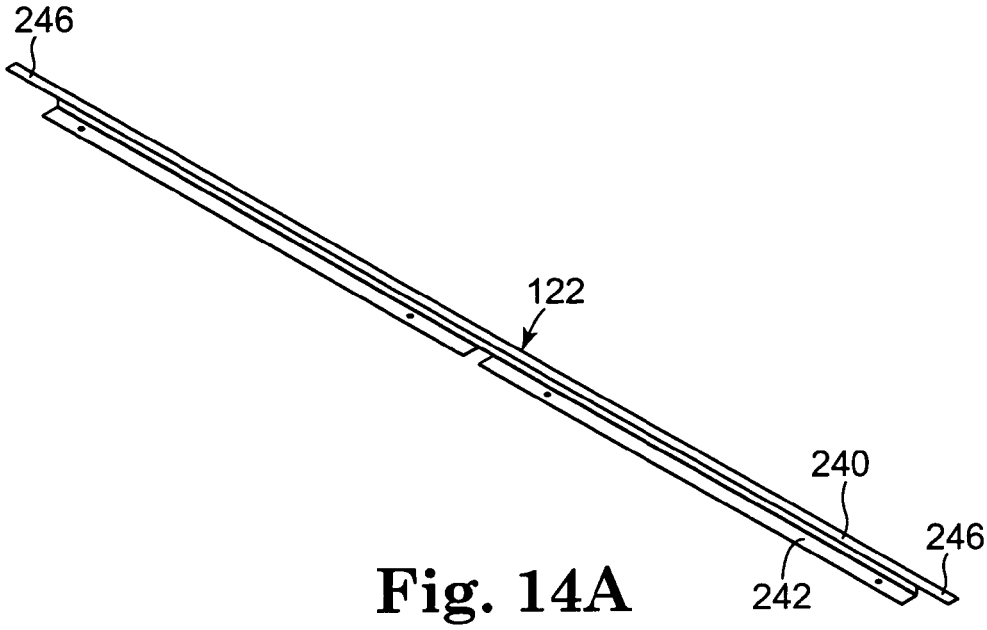
FIG. 14A is an isometric view of a bracket stop of a frame assembly of a display system, according to an embodiment of the present invention.
Figure 14B:
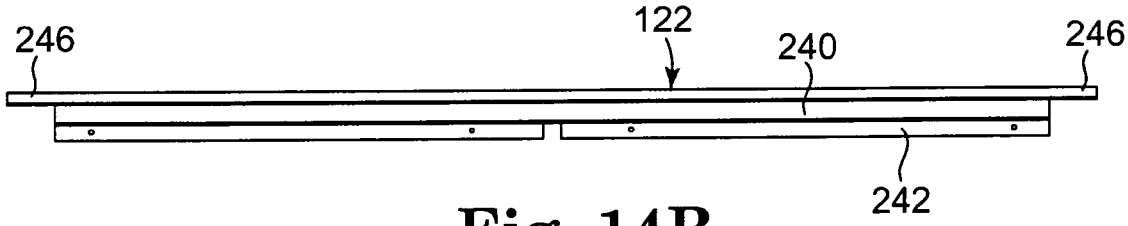
FIG. 14B is a plan view of a bracket stop of a frame assembly of a display system, according to an embodiment of the present invention.
Figure 14C:
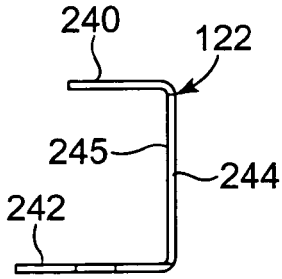
FIG. 14C is an end view of a bracket stop of a frame assembly of a display system, according to an embodiment of the present invention.

FIGS. 14A-14C are isometric, plan, and end views, respectively, of fifth bracket stop 122. As shown in FIGS. 14A-14C, fifth bracket stop 122 comprises upper portion 240, apertured lower portion 242, and central portion 244, which together define channel 245. In one embodiment, upper portion 240 comprises end portions 246 which extend laterally outward at opposite ends of fifth bracket stop 122 for insertion into and slidable movement within side members 62 of frame assembly 100 (FIG. 5). Apertures within lower portion 242 enable securing fifth bracket stop 122 to member 154 of base frame 110, which is shown in more detail in association with FIG. 18.

Figure 15A:
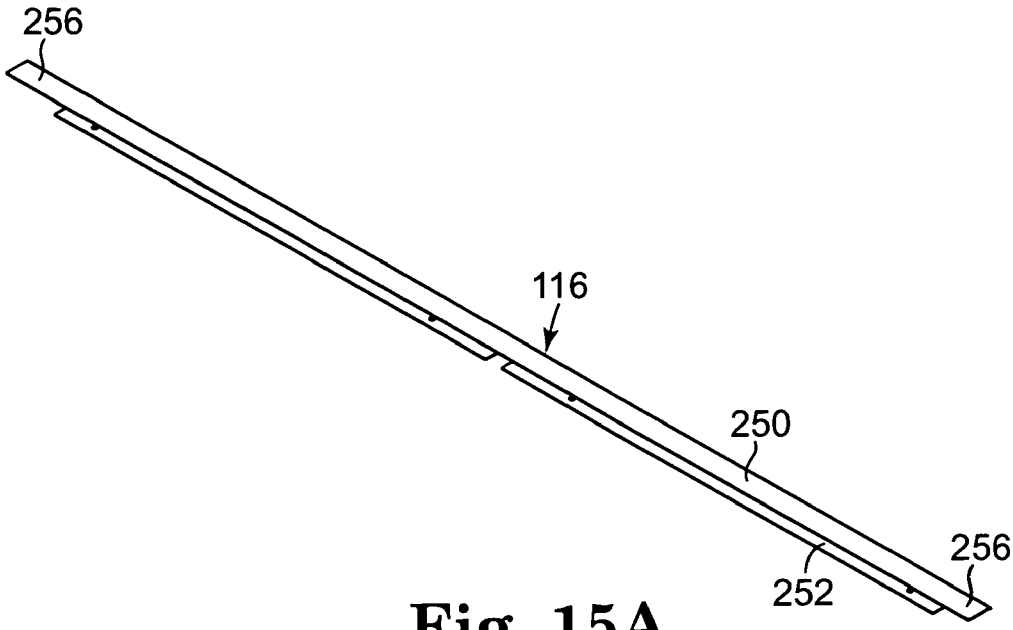
FIG. 15A is an isometric view of a bracket stop of a frame assembly of a display system, according to an embodiment of the present invention.
Figure 15B:
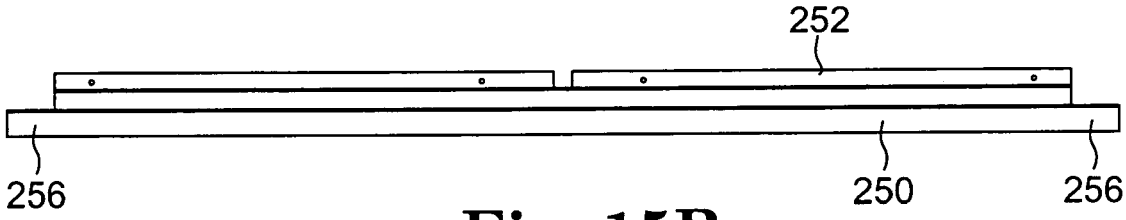
FIG. 15B is a plan view of a bracket stop of a frame assembly of a display system, according to an embodiment of the present invention.
Figure 15C:
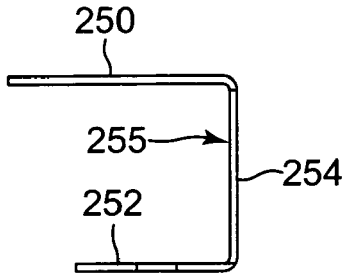
FIG. 15C is an end view of a bracket stop of a frame assembly of a display system, according to an embodiment of the present invention.

FIGS. 15A-15C are isometric, plan, and end views, respectively, of second bracket stop 116. As shown in FIGS. 15A-15C, second bracket stop 116 comprises upper portion 250, apertured lower portion 252, and central portion 254, which together define channel 255. In one embodiment, upper portion 250 comprises end portions 256 which extend laterally outward at opposite ends of second bracket stop 116 for insertion into and slidable movement within side members 62 of frame assembly 100 (FIG. 5). Apertures within lower portion 252 enable securing second bracket stop 116 to member 152 of base frame 110, which is shown in more detail in association with FIG. 18.

Figure 16A:
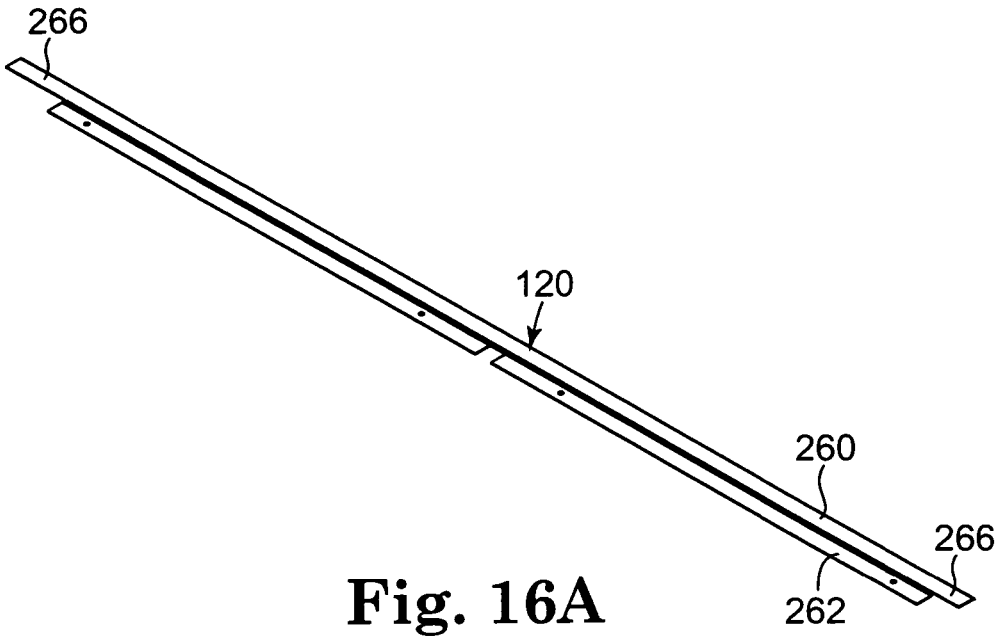
FIG. 16A is an isometric view of a bracket stop of a frame assembly of a display system, according to an embodiment of the present invention.
Figure 16B:
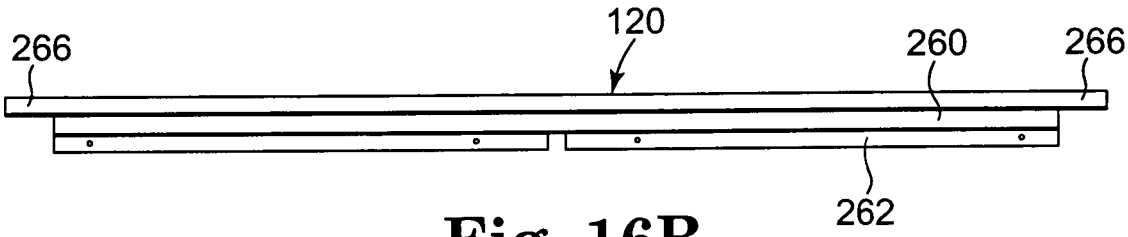
FIG. 16B is a plan view of a bracket stop of a frame assembly of a display system, according to an embodiment of the present invention.
Figure 16C:
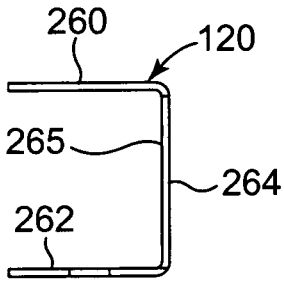
FIG. 16C is an end view of a bracket stop of a frame assembly of a display system, according to an embodiment of the present invention.

FIGS. 16A-16C are isometric, plan, and end views, respectively, of fourth bracket stop 120. As shown in FIGS. 16A-16C, fourth bracket stop 120 comprises upper portion 260, apertured lower portion 262, and central portion 264, which together define channel 265. In one embodiment, upper portion 260 comprises end portions 266 which extend laterally outward at opposite ends of fourth bracket stop 120 for insertion into and slidable movement within side members 62 of frame assembly 100 (FIG. 5). Apertures within lower portion 262 enable securing fourth bracket stop 120 to member 154 of base frame 110, which is shown in more detail in association with FIG. 18.

Figure 17:
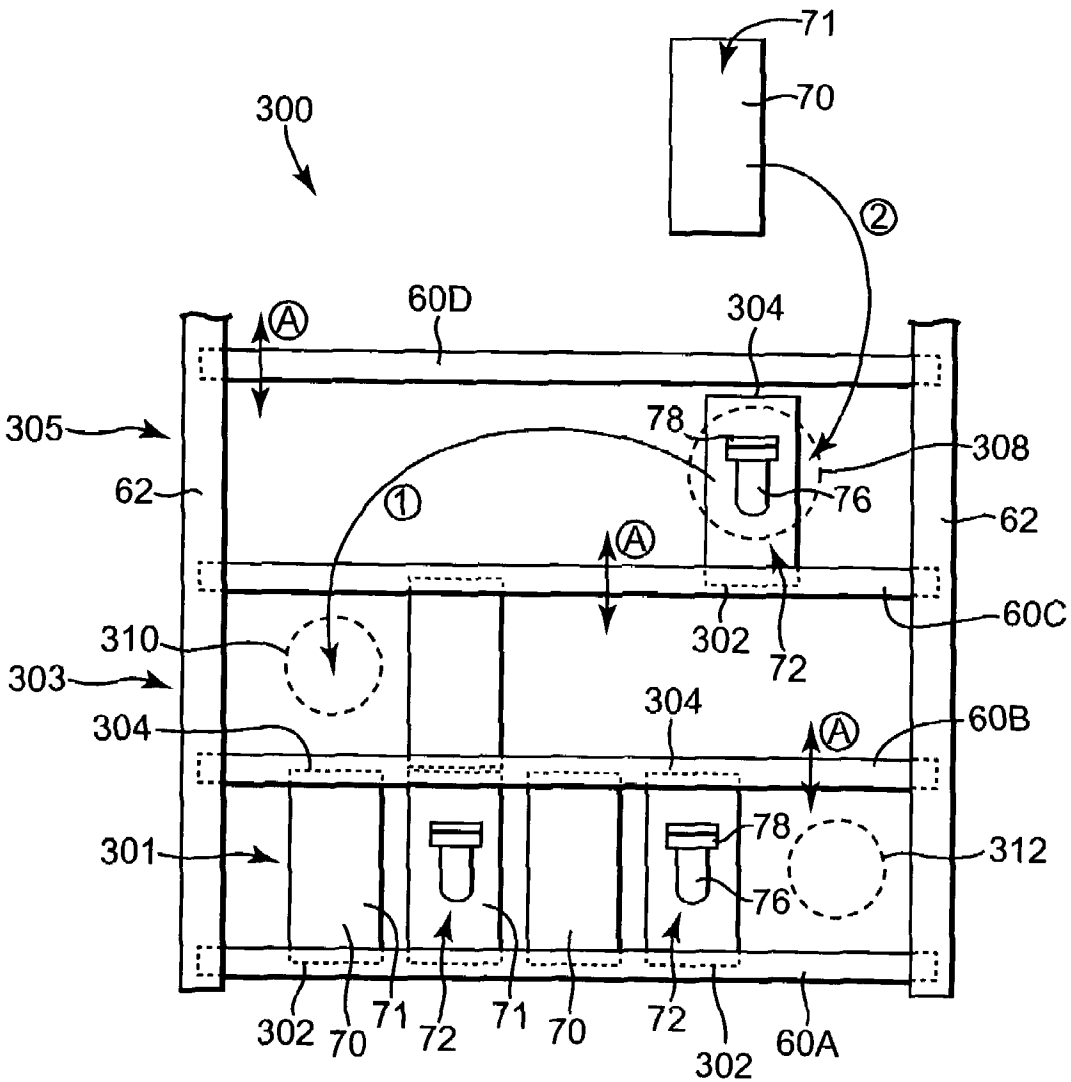
FIG. 17 is a plan view schematically illustrating use of a reconfigurable display, according to an embodiment of the present invention.

FIG. 17 is plan view schematically illustrating one embodiment of a display system 300. Display system 300 has substantially the same features and attributes as display system 50 of the embodiments of FIGS. 1-16. As shown in FIG. 17, rails 60A-60D are horizontally supported on a frame in a generally parallel, spaced relationship. In one embodiment, the frame corresponds to frame assembly 100 in the embodiment of FIGS. 1-16C. Moreover, the ends of rails 60A-60D are positioned for slidable movement relative to side members 62 of the frame in a direction generally perpendicular to a longitudinal axis of each rail (as indicated by directional arrows A). A first row 301 of display units 71 is supported between adjacent rails 60A and 60B and a second row 303 of display units 71 is supported between adjacent rails 60B and 60C. Similarly, a third row 305 of display units 71 is supported between adjacent rails 60C and 60D. Display units 71 within first row 301, second row 303, and third row 305 comprise a device support unit 72 and/or a plate 70/74.

Display system 300, which schematically represents display system 50, enables reconfiguring the array of display units 71 to move selected units among the different rows to achieve a desired configuration of plates 70/74 and device support units 72 in each row. A desired configuration includes selecting the number of each type of display unit 71 (plate 70/74 and/or device support unit 72) that will be in each row (e.g. rows 301, 303, 305) as well as the sequence of the different types of display units 71 from left to right. As shown in FIG. 17, first row 301 alternates between plates 74 and device support units 72 from left to right. Moreover, display system 300 is not limited to three rows of display units 71, and may include more than three rows or less than three rows of display units 71.

As shown in FIG. 17, each display unit 71 includes first end 302 and second end 304 which slidably fit into adjacent rails. For example, in first row 301, first end 302 of each display unit 71 is slidably fit within a lower rail 60A while second end 304 is slidably fit into adjacent upper rail 60B.

To reconfigure display units 71 in system 300, a display unit is selected from a location in the array of display units 71, such as location 308, for removal. Accordingly, as indicated by directional arrow 1, device support unit 72 from third row 305 is removed and inserted into location 310 of second row 303. The specific manner in which rails 60A-60D are manipulated to accomplish removal and insertion of display units 71 is described in more detail in association with e.g. FIGS. 18, 19A, and 19B. In this example, to remove device support unit 72 from third row 305, rails 60C and 60D are moved apart from each other a small amount to increase the separation distance between them, to permit second end 304 to be moved freely out from rail 60D and then out from rail 60C. This maneuver is described and illustrated in more detail in association with e.g. FIGS. 19A and 19B.

In addition, as indicated by directional arrow 2, a plate 70 and/or device support unit 72 supplied from another location on display system 300 or from elsewhere is inserted into location 308, from which device support unit 72 was just removed. Of course, plate 74 also can be inserted instead in other locations in display system 300 that are open to receive a display unit 71.

Figure 18:
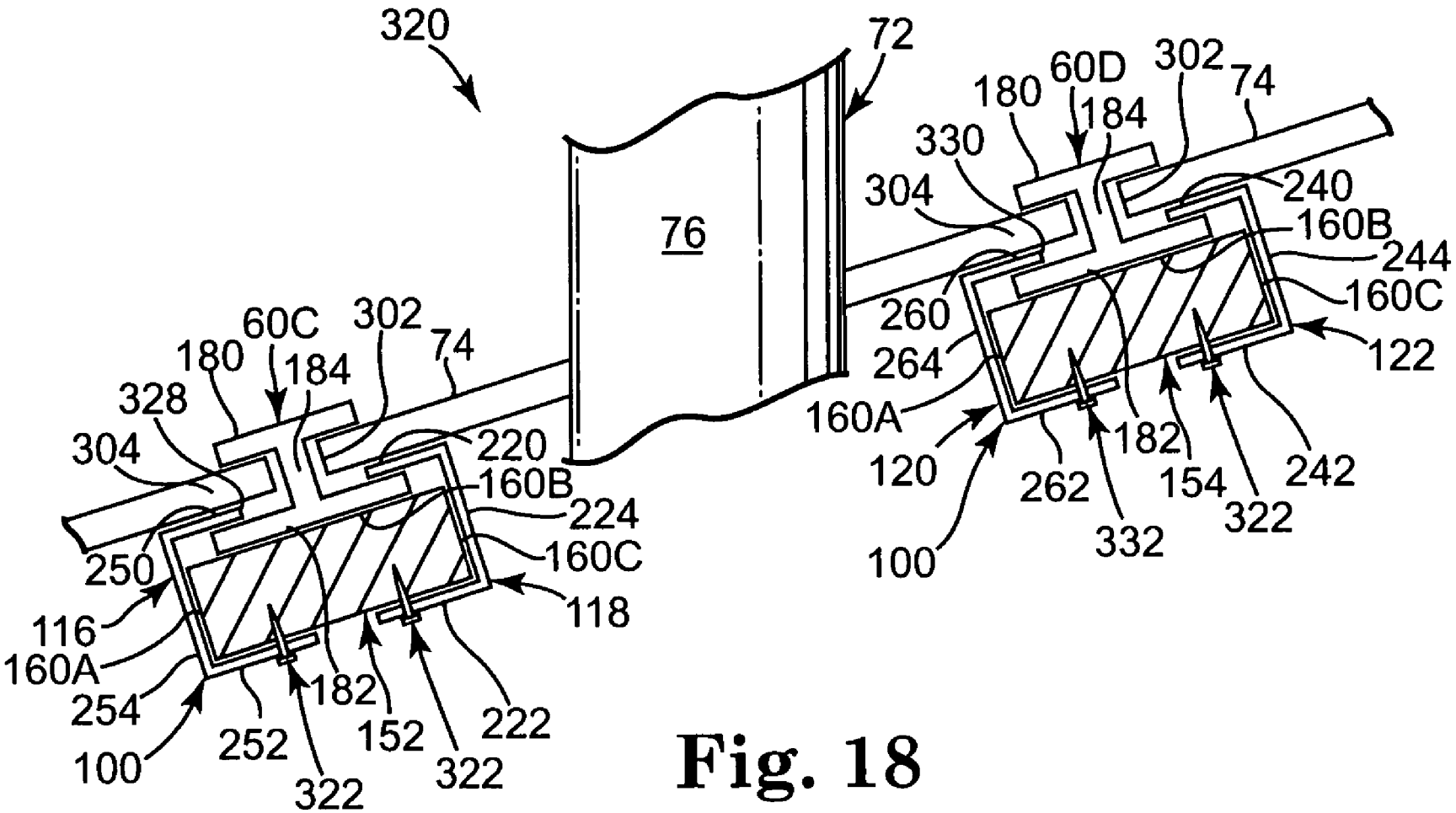
FIG. 18 is an enlarged sectional view of a display system, according to an embodiment of the present invention.

FIG. 18 is a sectional view schematically illustrating a device support unit 72 secured within a row (e.g. third row 305 of FIG. 17) of display units 71 between rail 60C and 60D. FIG. 18 illustrates the relationship between the rails 60C, 60D and various components of frame assembly 100 that support the position and selective movement of rails 60C, 60D relative to frame assembly 100. All of the components of frame assembly 100 shown in FIG. 18 have been previously described in association with e.g. FIGS. 3 and 5-16C.

As shown in FIG. 18, rail 60C is supported on member 152 of frame base 110 via bracket stops 116 and 118, which are secured to member 152 via fasteners 322. Bottom portion 182 of rail 60C rests on top 160B of frame member 152. Upper portion 250 of bracket stop 116 and upper portion 220 of bracket stop 118 are spaced above top 160B of frame member 152 to maintain bottom portion 182 of rail 60C over frame member 152 while permitting limited sliding movement of rail 60C toward front 160A of member 152 or toward back 160C of member 152. The extent of this sliding movement of rail 60C relative to frame member 152 (and thereby relative to frame assembly 100) is determined by the diameter of opening 328, which is the space between an end of upper portion 250 of bracket stop 116 and an end of upper portion 220 of bracket stop 118. This diameter of opening 328 determines how far portion 184 of rail 60C can travel in either direction (left or right as seen in the drawing) before portion 184 contacts an end of upper portion 250 of bracket stop 116 or contacts an end of upper portion 220 of bracket stop 118.

In another embodiment, bracket stops 116 and 118, frame member 152, and lower portion 182 of rail 60C are dimensioned so that lower portion 182 rests on top 160B of frame member 152, and upper portion 250 of bracket stop 116 and upper portion 220 of bracket stop 118 also rest on top 160B of frame member 152, so that upper portions 250 and 220 of bracket stops 116, 118, respectively, are substantially coplanar with lower portion 182 of rail 60C. In this arrangement, lower portion 182 of rail 60C is permitted to slide back and forth between ends of upper portion 250 of bracket stop 116 and upper portion 220 of bracket stop 118 to enable movement of rail 60C relative to frame assembly 100. A similar modification is optionally made to bracket stops 120 and 122, and frame member 154, in association with rail 60D.

As also shown in FIG. 18, rail 60D is supported on member 154 of frame base 110 via bracket stops 120 and 122, which are secured to member 154 via fasteners 322. Bottom portion 182 of rail 60D rests on top 160B of frame member 154. Upper portion 260 of bracket stop 120 and upper portion 240 of bracket stop 122 are spaced above top 160B of frame member 154, to maintain bottom portion 182 of rail 60D over frame member 154 while permitting limited sliding movement of rail 60D toward front 160A of member 154 or toward back 160C of member 154. The extent of this sliding movement of rail 60C relative to frame member 154 (and thereby relative to frame assembly 100) is determined by the diameter of opening 330, which is the space between an end of upper portion 260 of bracket stop 120 and an end of upper portion 240 of bracket stop 122. This diameter of opening 330 determines how far portion 184 of rail 60D can travel in either direction (left or right as seen in the drawing) before portion 184 contacts an end of upper portion 260 of bracket stop 120 or contacts an end of upper portion 240 of bracket stop 122.

Rails 60A, 60B, 60E are positioned on, and are selectively moved relative to, frame assembly 100 in substantially the same manner as for rails 60C and 60D, except for rails 60B,60E being associated with a different set of corresponding components (e.g., bracket stops, frame members) of frame assembly 100 as has been previously described in association with FIGS. 1-16C.

Figure 19A:
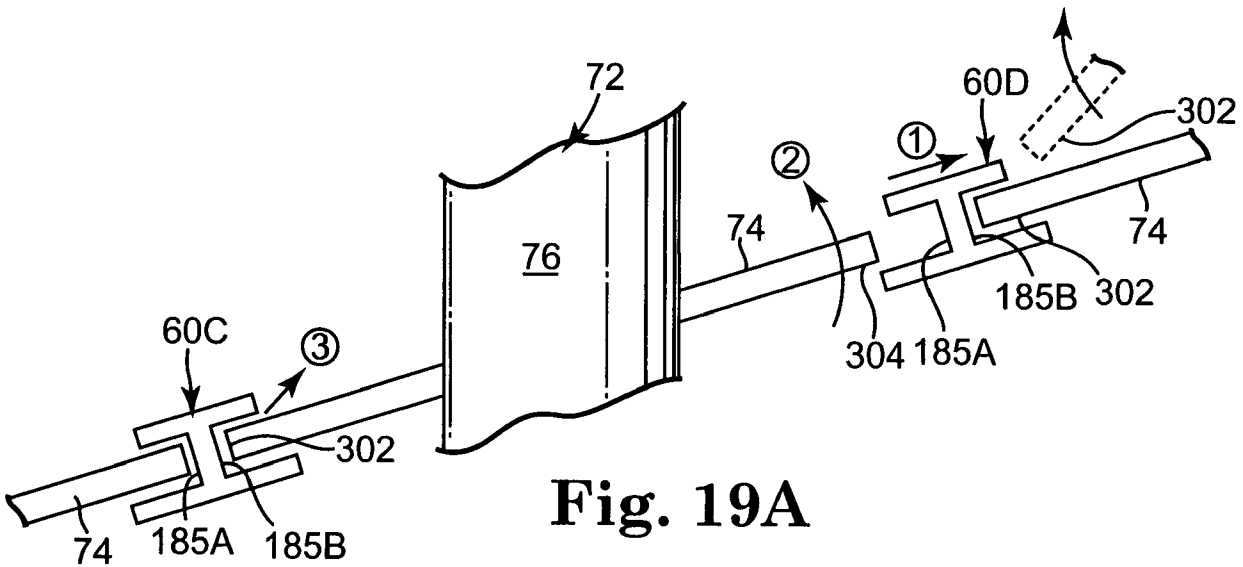
FIG. 19A is a side view schematically illustrating removal of a device display unit from a rail array of a display system, according to an embodiment of the present invention.
Figure 19B:
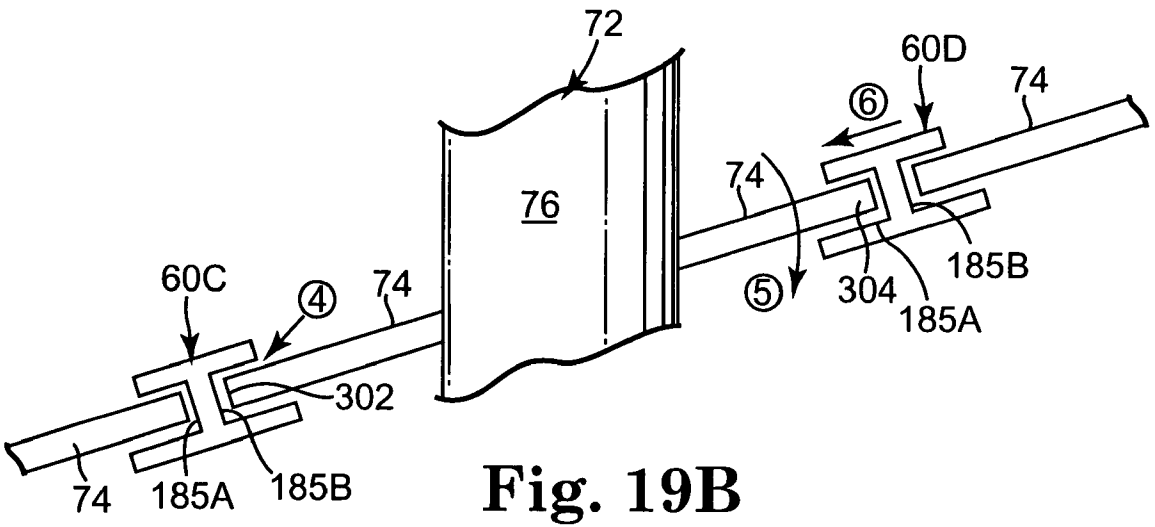
FIG. 19B is a side view schematically illustrating insertion of a device display unit of a display system, according to an embodiment of the present invention.

FIGS. 19A, 19B are sectional views schematically illustrating removal and insertion, respectively, of device support unit 72 relative to rails 60C, 60D.

As shown in FIG. 19A, device support unit 72 is removed from frame assembly 100 by first sliding rail 60D relative to frame member 154 of assembly 100 (e.g., shown in FIG. 18) in a direction generally perpendicular to a longitudinal axis of rail 60D to increase the space between end 304 of plate 74 and channel 185A of rail 60D, as indicated by directional arrow 1. This sliding movement increases a separation distance between adjacent pair of rails 60C, 60D to enable removal of device support unit 72 from its supported position between rails 60C, 60D. Next, as indicated by directional arrow 2, second end 304 of plate 74 is rotated upwardly away from rail 60D, thereby releasing second end 304 of plate 74 from rail 60D. Finally, as indicated by directional arrow 3, first end 302 of plate 74 is slidably removed out of channel 185B of rail 60C, thereby permitting complete removal of plate 74 of device support unit 72 from its previously supported position between adjacent pair of rails 60C and 60D.

A substantially similar maneuver is performed to remove device support unit 72 from a supported position between another adjacent pair of rails, such as rails 60A and 60B.

Finally, a substantially similar maneuver is performed to remove a plate 70 from a supported position between rails 60C, 60D, or another adjacent pair of rails (e.g. 60A and 60B) in order to enable reconfiguring device support units 72 and/or plates 70 within a row (from left to right, or vice versa) or between rows (e.g. rows 301, 303, 305) of a display system, such as display system 300 of FIG. 17.

As shown in FIG. 19B, device support unit 72 is inserted into a position on display system 300 and, in particular, supported by frame assembly 100, by first slidably inserting first end 302 of plate 74 into channel 185B of rail 60C, as indicated by directional arrow 4. Next, as indicated by directional arrow 5, second end 304 of plate 74 is rotated downward toward rail 60D, thereby positioning second end 304 of plate 74 for slidably mating with channel 185A of rail 60D. Finally, as indicated by directional arrow 6, rail 60D is slidably advanced relative to frame assembly 100 (not shown) in a direction generally perpendicular to rail 60D, so that second end 304 of plate 74 of device support unit 72 is removably fixed within channel 185B of rail 60D, thereby establishing plate 74 of device display unit in a supported position between rails 60C and 60D. This maneuver decreases the separation distance between rails 60C and 60D to establish pressing contact between rail 60C, plate 74 of device support unit 72 and, rail 60D.

A substantially similar maneuver is performed to insert device support unit 72 into a supported position between another adjacent pair of rails, such as rails 60A and 60B.

Finally, a substantially similar maneuver is performed to insert a plate 70 into a supported position between rails 60C, 60D, or another adjacent pair of rails (e.g. 60A and 60B) in order to enable reconfiguring device support units 72 and/or plates 70 within a row (from left to right, or vice versa) or between rows (e.g. rows 301, 303, 305) of a display system, such as display system 300 of FIG. 17.

Figure 20:
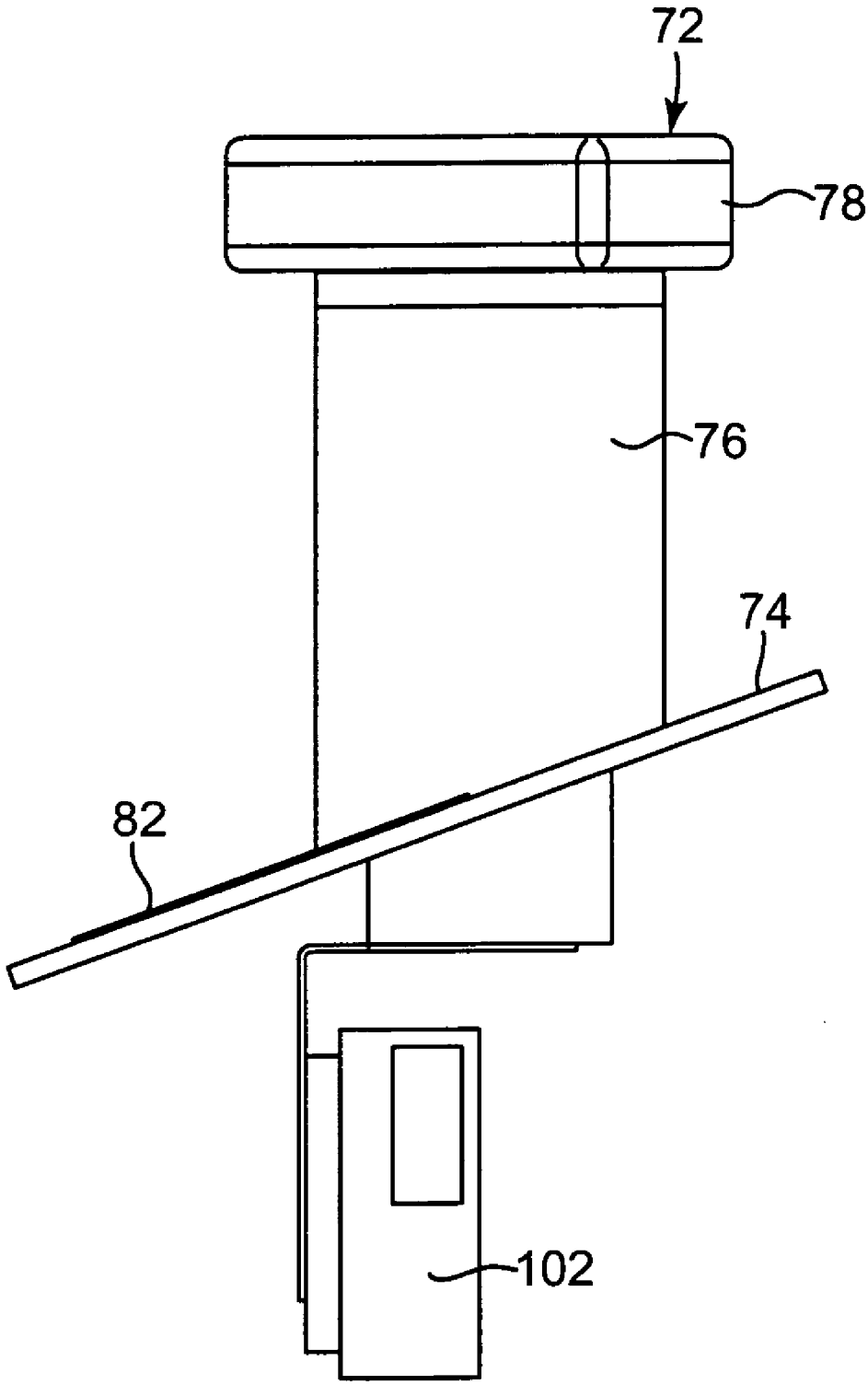
FIG. 20 is a side view of a device display unit of a display system, according to an embodiment of the present invention.

FIG. 20 is an enlarged side view of device support unit 72 illustrating previously described plate 74, post 76, bracket 78, sign unit 82, and retractable cord unit 102. Components disposed above plate 74 are generally in view of a consumer, and components disposed below plate 74 are generally hidden from view.

Figure 21:
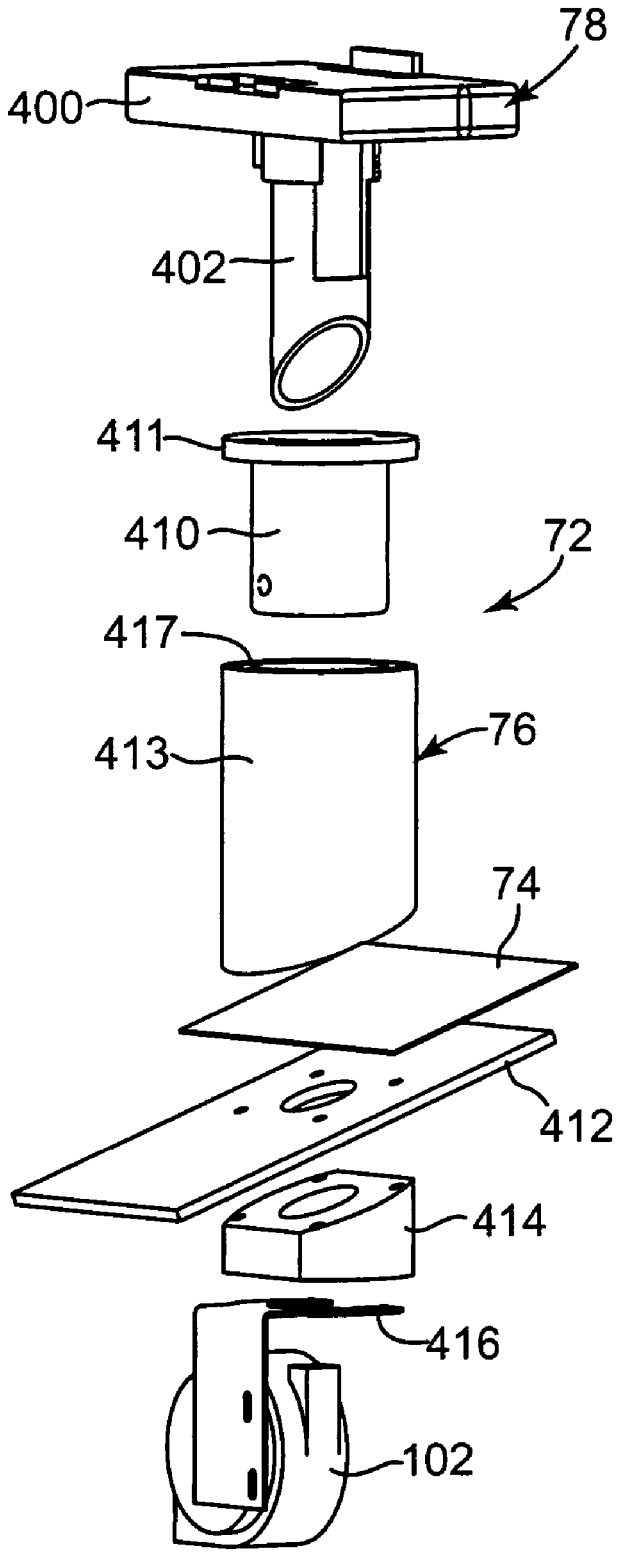
FIG. 21 is an exploded side view of a device display unit of a display system, according to an embodiment of the present invention.

FIG. 21 is an exploded view of device support unit 72 illustrating its various components in more detail. As shown in FIG. 21, device support unit 72 comprises bracket 78 including support plate 400 and stem 402, which is slidably received into tube 410 having flange 411. Jacket 413 slidably receives tube 410 with flange 411 resting on an upper surface 417 of jacket 413. Plate 412 and base 414 together support plate 74, jacket 413, tube 410, and stem 402. In addition, bracket 416 is positioned for securing retractable cord unit 102 to base 414.

Figure 22:
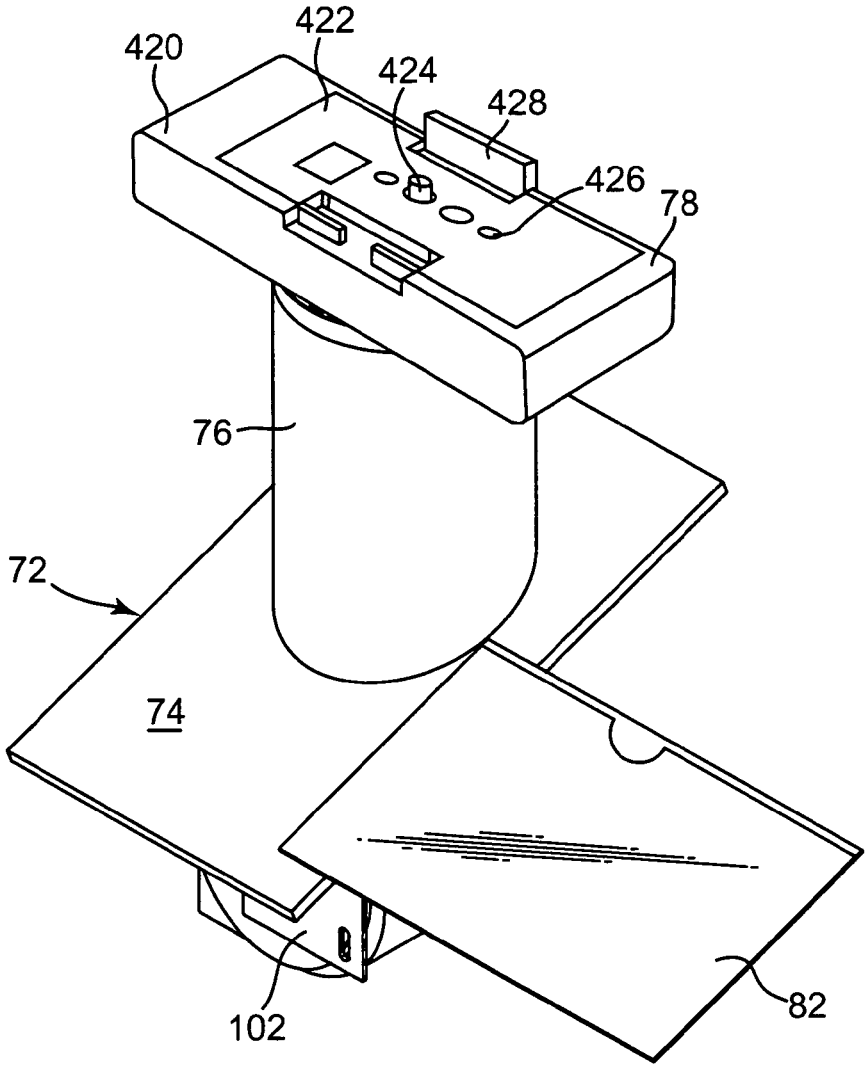
FIG. 22 is an isometric view of a device display unit, according to an embodiment of the present invention.
Figure 22A:
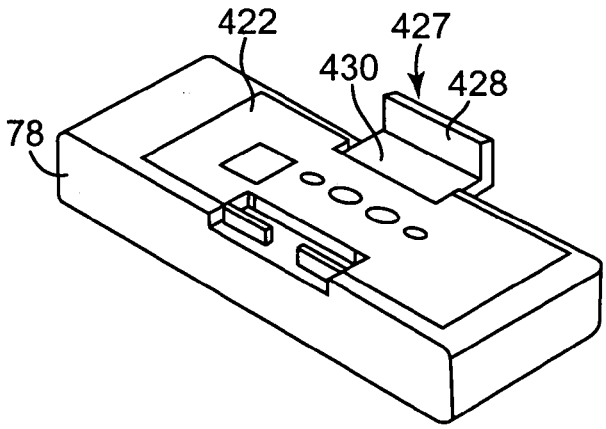
FIG. 22A is an isometric view of a device display unit portion in an alternative configuration, according to an embodiment of the present invention.

FIG. 22 is an isometric view of device support unit 72 illustrating its various components, including plate 74, post 76, bracket 78, and sign unit 82, in more detail. Bracket 78 includes post cover 420, cover plate 422 supporting mounting screw 424 for connection to the camera or other product to be supported, a plurality of apertures 426 for accommodating and/or supporting components such as one or more antirotation pins for generally preventing or limiting rotation of the camera or other product with respect to plate 422, one or more limit switches, etc. FIGS. 22 and 22A also show slide bracket 427, which includes lip 428 for abutting e.g. a rear or edge of the camera or other product, and base 430, which is connected to lip 428 at generally a right angle and slides back and forth between plate 422 and cover 420 to a desired position to precisely accommodate the camera or other product. Once slide bracket 427 is moved to a desired position, it may be locked in place by e.g. tightening mounting screw 424 into the base of the camera, thereby tightening base 430 against the underside of plate 422.

Figure 23:
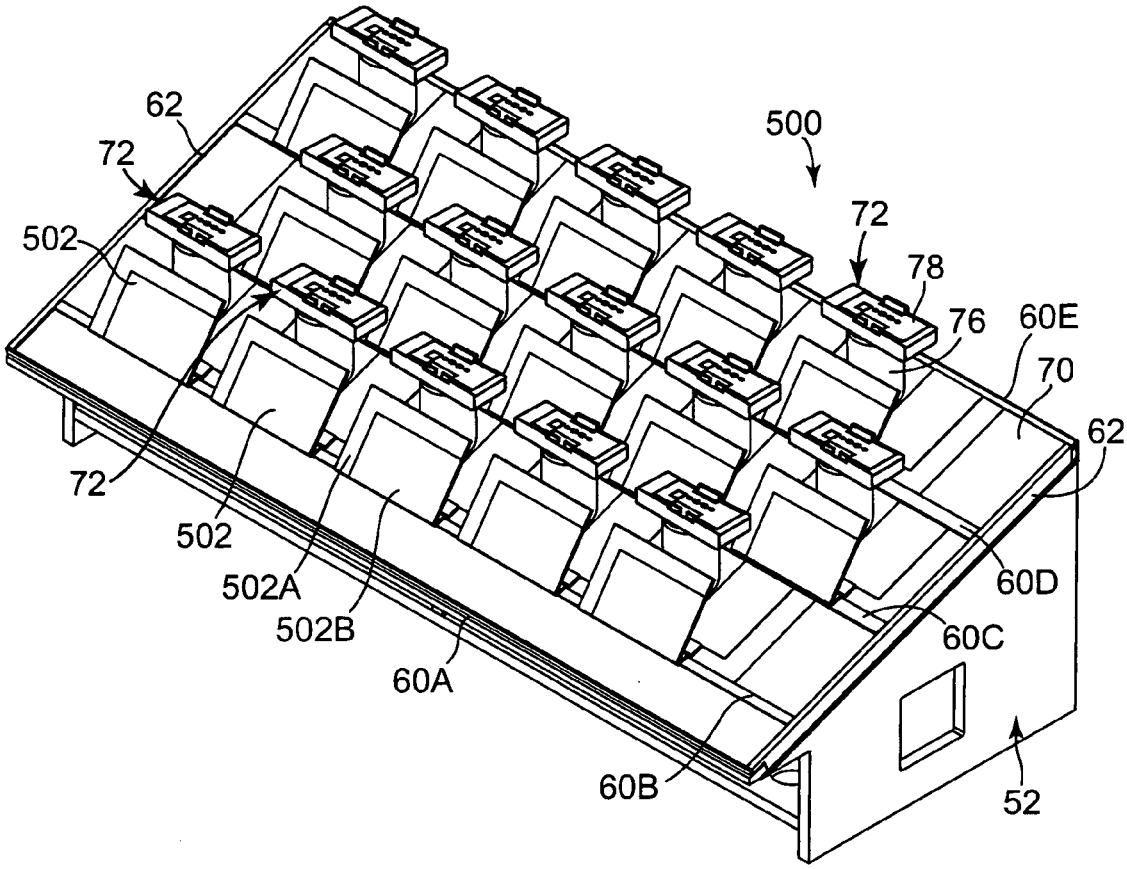
FIG. 23 is an isometric view of a display system, according to an embodiment of the present invention.

FIG. 23 is an isometric view of another embodiment of display system 500. As shown in FIG. 23, display system 500 has substantially the same features and attributes of display system 50 of the embodiment of FIG. 1, except additionally comprising sign units 502 which are angled upwardly relative to plates 70, for example. Sign units 502 each comprise two sign holders or sign areas 502A, 502B. Sign holder 502A is of a relatively large size and forms a background element, and sign holder 502B is of a relatively small size and forms a foreground element. Sign units 502 are optionally removably secured to display system 500 in front of each device support unit 72.

Figure 24:
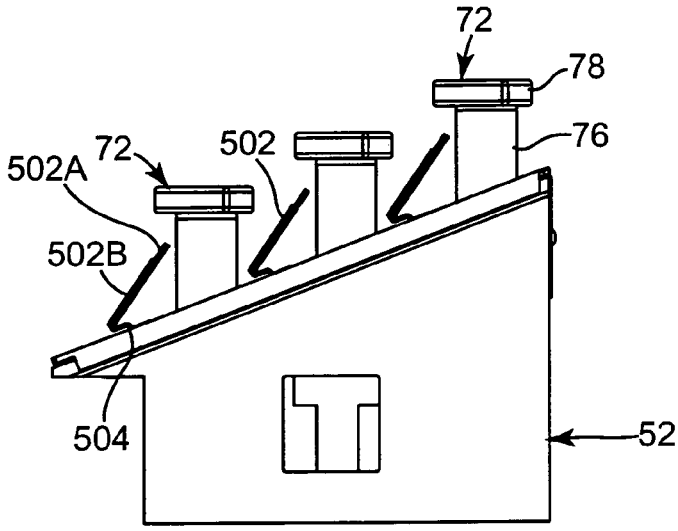
FIG. 24 is a side view of the display system of FIG. 23, according to an embodiment of the present invention.

FIG. 24 is a side view of display system 500. As shown in FIG. 24, sign units 502 are angled upwardly, and further comprise respective members 504 for removable securement of sign unit 502 adjacent device support units 72.

FIGS. 25-30 illustrate embodiments of a modular display system including a plurality of base modules and connecting modules for combination into an integrated display arrangement.

Figure 25:
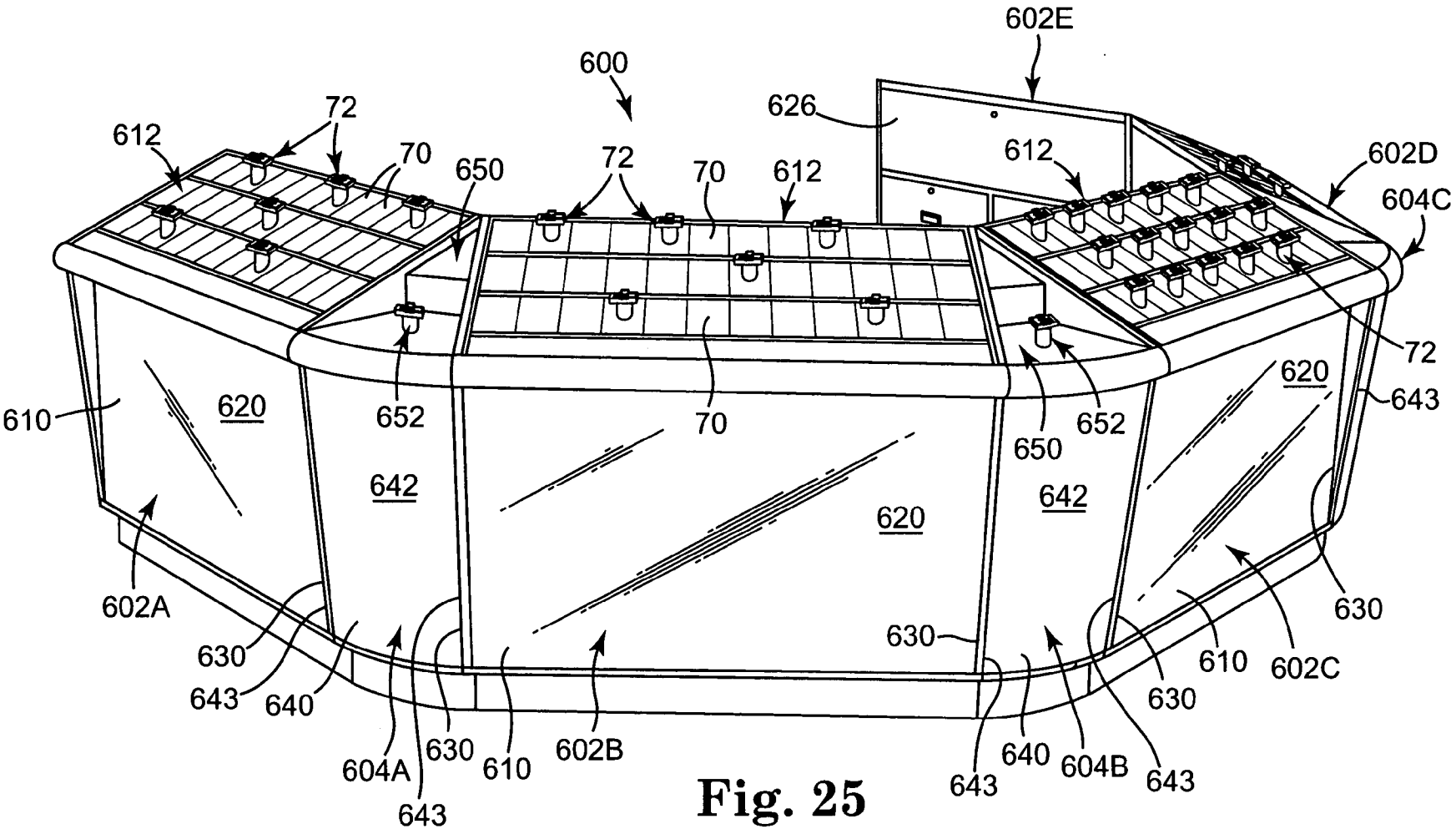
FIG. 25 is an isometric view of modular display system, according to an embodiment of the present invention.

FIG. 25 is an isometric view of display 600. As shown in FIG. 25, display 600 comprises base modules 602A, 602B, 602C, 602D, 602E, and connecting modules 604A, 604B, 604C and 604D (shown in FIG. 26). Each base module 602A-602E comprises cabinet 610, display system 612, face 620, and sides 630, as well as rear 626. Each connecting module 604A-604D comprises base 642, upper display area 650 for supporting one or more display units 652, and sides 643. Plates 70, display units 71, device support units 72, plates 74, and associated cameras or other products are reconfigurable and rearrangeable, and can be of any desired number, to form any number of different desired patterns, as shown e.g. by three different display systems 612 visible in FIG. 25.

Each display system 612 is or comprises one or more of display systems 50, 300 and provides a configurable array of plates 70 and device support units 72 as previously described in association with FIGS. 1-24, or another suitable display system for displaying consumer devices in a configurable array atop one or more of base modules 602A-602E.

Figure 26:
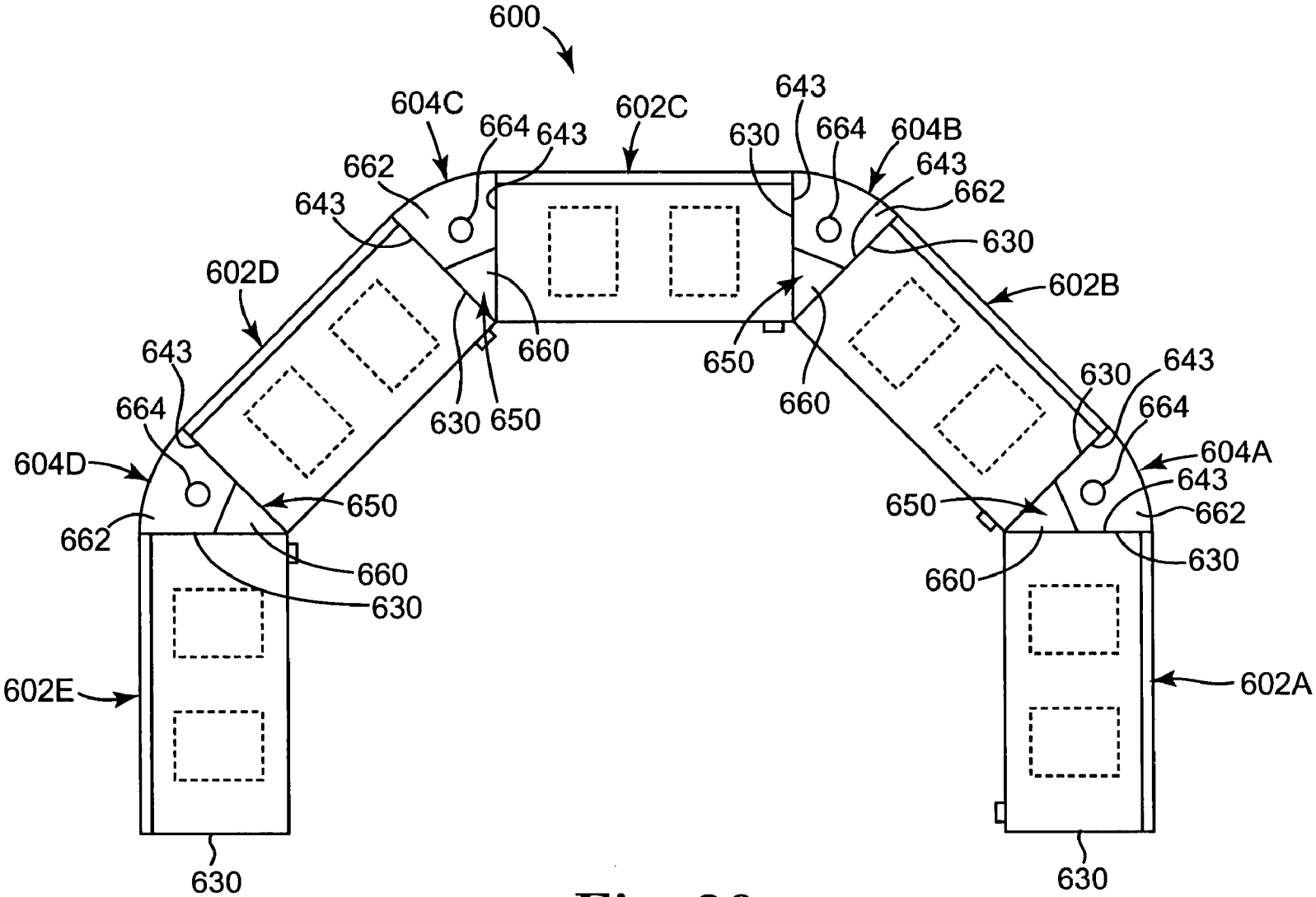
FIG. 26 is a top plan view of a modular display system, according to an embodiment of the present invention.

FIG. 26 is plan view of display system 600 illustrating base modules 602A-602E and connecting modules 604A-604E in one exemplary configuration, with display systems 612 removed from a top portion of base modules 602A-602E for illustrative purposes. As shown in FIG. 26, a display area of connecting modules 604A-604D comprises upper surface 660 and lower surface 662 having aperture 664 for receiving a display unit 652, which may be display unit 71 described earlier herein. Base modules 602A-602E are arranged side by side with connecting modules 604A-604E in an alternating fashion. Sides 630 of each base module (e.g. base module 602A) are in contact with sides 643 of each connecting module (e.g. connecting module 604A). Sides 643 of a single connecting module (e.g. module 604A) form an angle of about 45 degrees so that a side 630 of one base module, such as base module 602A, is at a roughly 45 angle relative to side 630 of base module 602B. This pattern is repeated among adjacent base modules 602B-602E and connecting modules 604B interspersed between those respective base modules 604A-604E so that the entire arrangement forms a roughly 180 degree panoramic configuration. This arrangement enables modular display system 600 to present five base modules 602A-602E that face consumers over a 180 degree area, enhancing access to configurable device display systems 612 that sit atop base modules 602A-602E. Connecting modules 604A-604E provide additional display surfaces (e.g. surfaces 660, 662) interspersed between the adjacent base modules (e.g., adjacent base modules 602A and 602B), and provide substantial continuity to displays and display surfaces along the front surfaces and top surfaces between the adjacent base modules 602A-602E and connecting modules 604A-604E.

Figure 27:
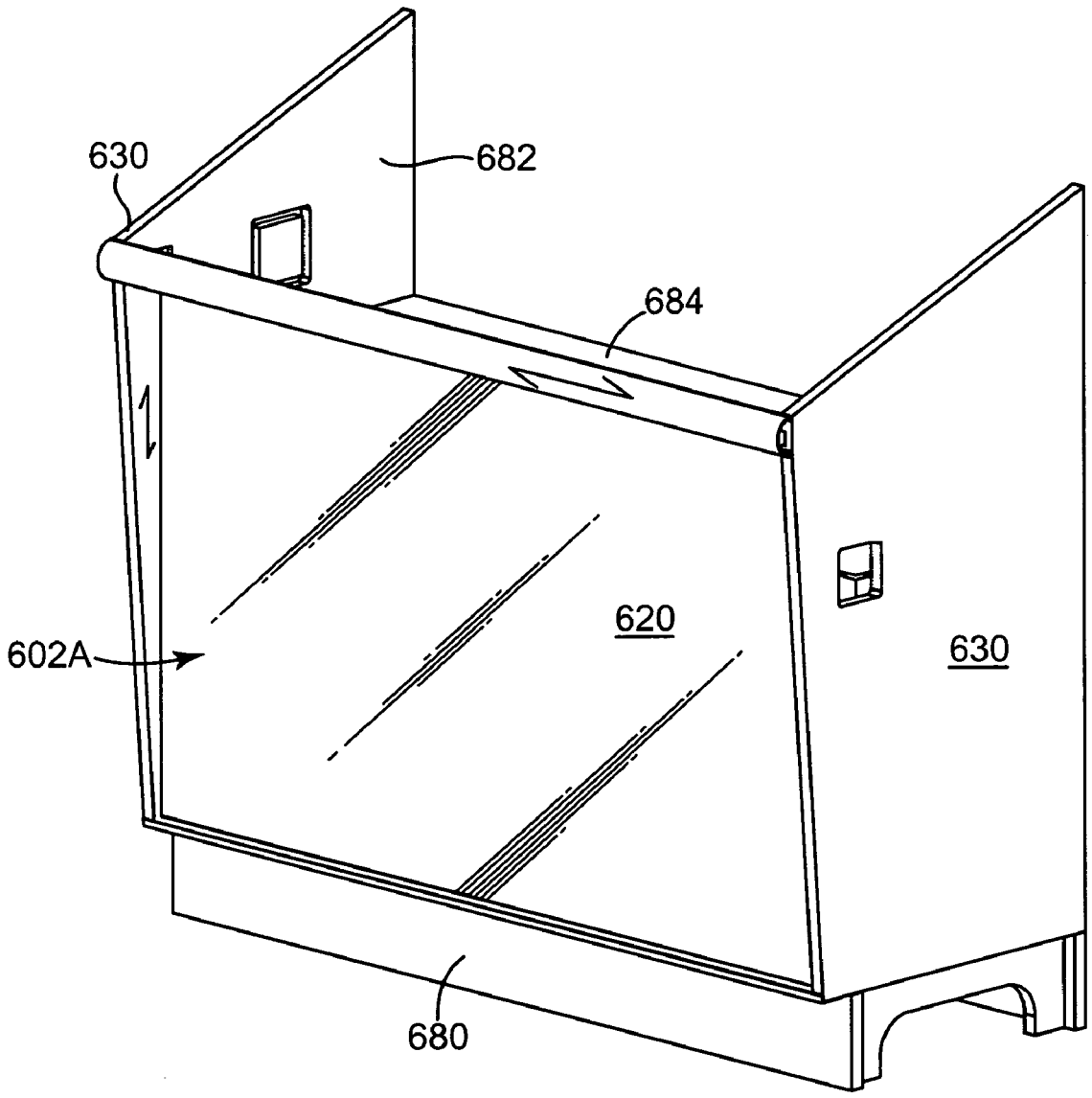
FIG. 27 is a front isometric view of a base module of a display system, according to an embodiment of the present invention.

FIG. 27 is a front isometric view of base module 602A, which is representative of all base modules 602A-602E. As shown in FIG. 27, base module 602A comprises front face 620, sides 630, feet 680, upper side portions 682 for supporting a display system 612 (or other configurable display system) and desktop portion 684 for interior storage of items below display system 612.

Figure 28:
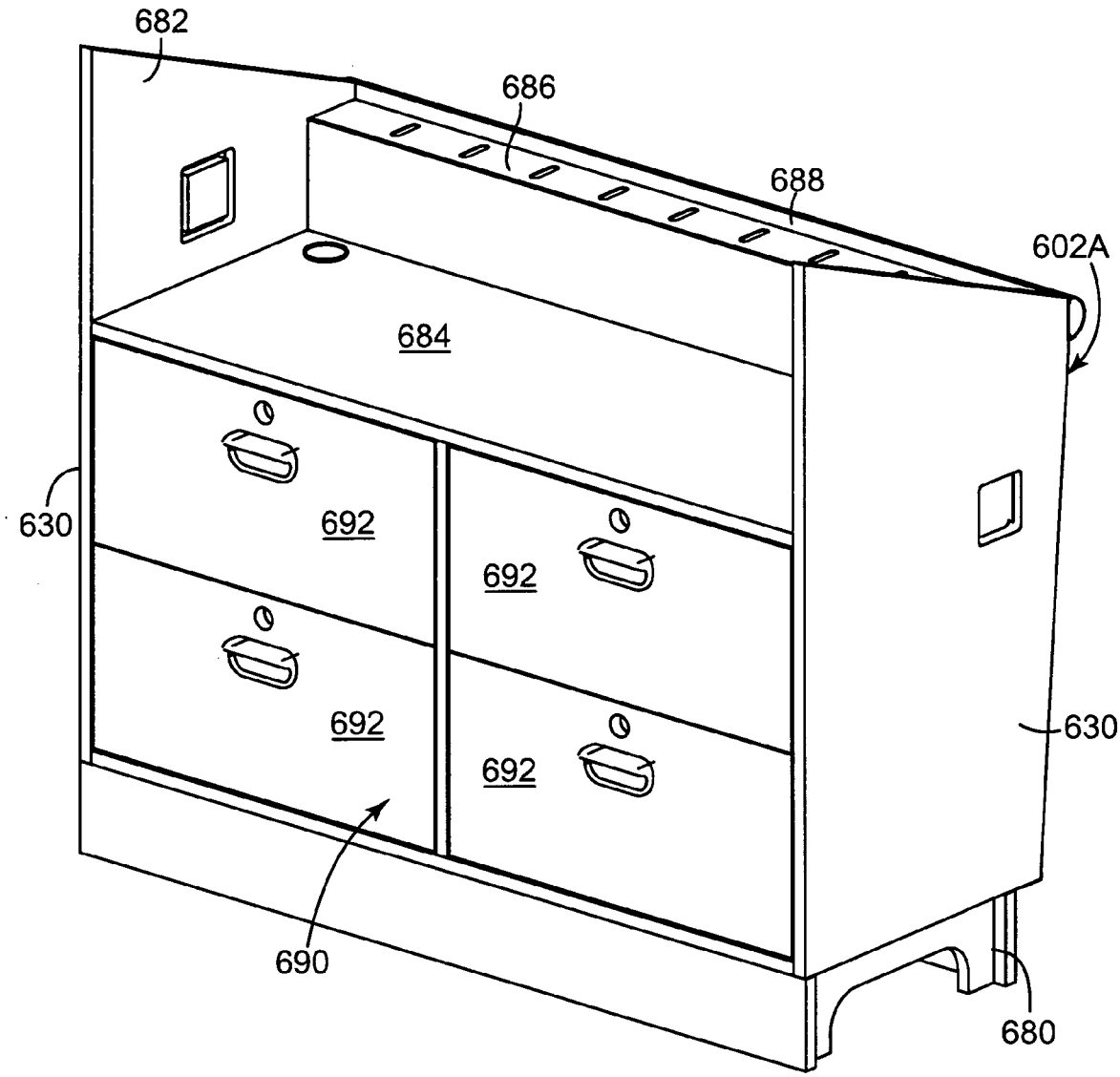
FIG. 28 is a rear isometric view of a base module of a display system, according to an embodiment of the present invention.

FIG. 28 is a rear isometric view of base module 602A, which is representative of all base modules 602A-602E. As shown in FIG. 28, base module 602A comprises sides 630, feet 680, upper side portions 682 for supporting a display system 612 (or other configurable display system), desktop portion 684 for interior storage of items below display system 612, an array 690 of lockable drawers 692, as well as lateral support member 686 and lip 688 for additional support of display system 612 or another suitable system for displaying consumer devices atop base module 602A.

Figure 29:
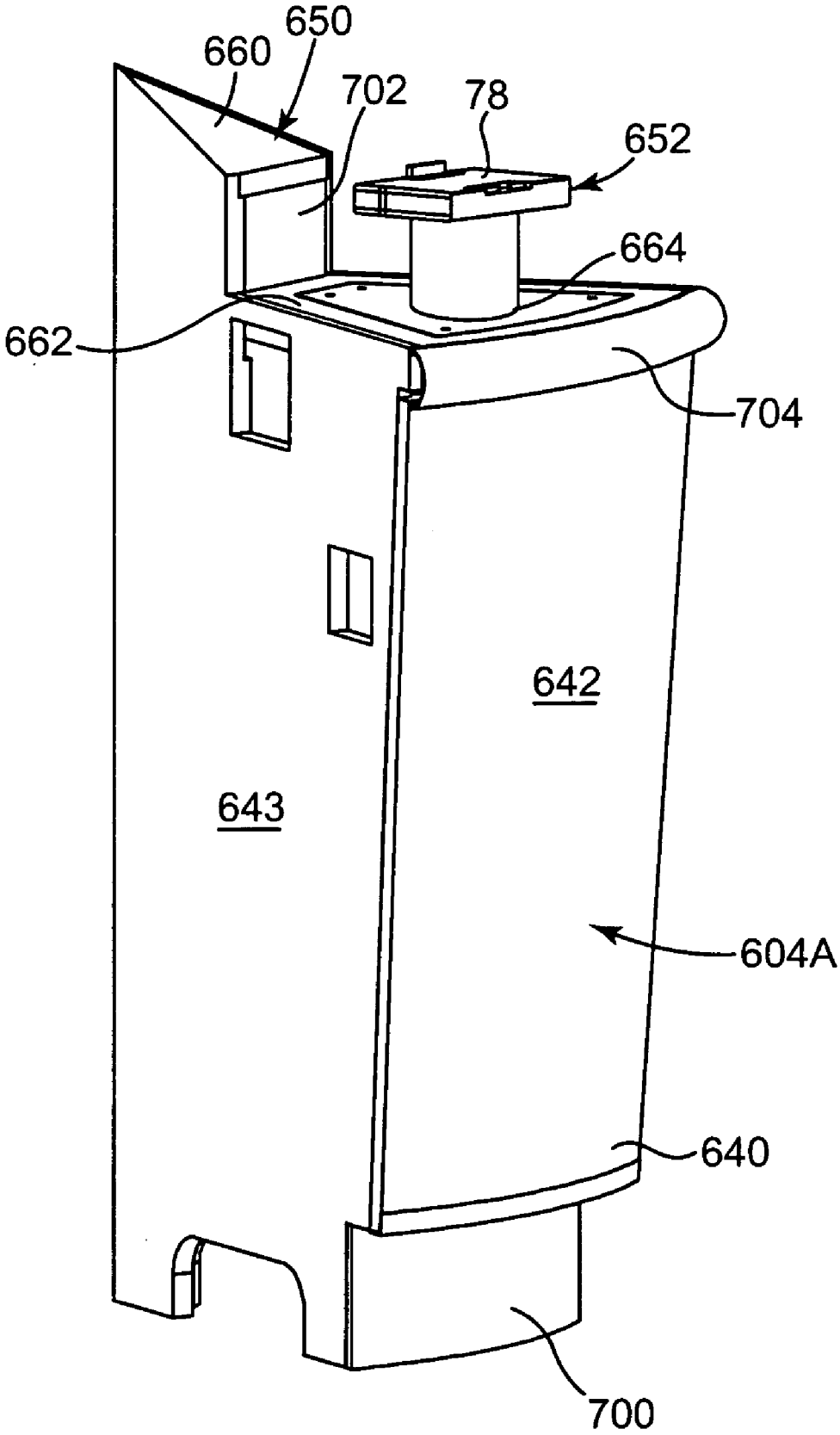
FIG. 29 is a front isometric view of a connector module of a display system, according to an embodiment of the present invention.

FIG. 29 is an isometric view of connecting module 604A, which is representative of all connecting modules 604A-604D. As shown in FIG. 29, connecting module 604A comprises front face 642, bottom portion 640, feet 700, sides 643, display area 650 which includes upper surface 660, lower surface 662, and vertical surface 702, and front lip 704. Display unit 652 is inserted into aperture 664 for supporting and displaying bracket 78 adapted to receive a consumer device, such as a camera.

Figure 30:
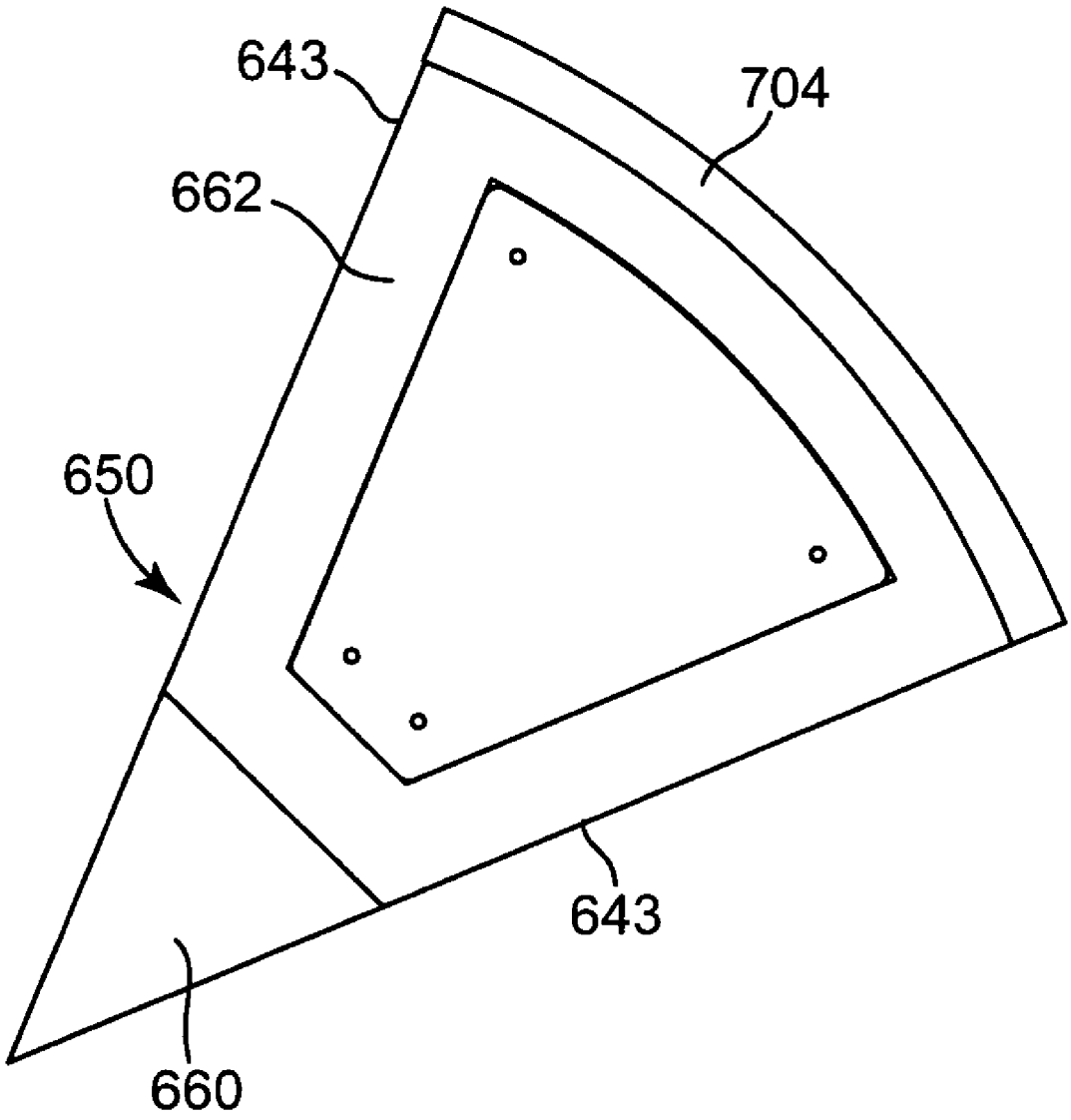
FIG. 30 is a top plan view of a connector module of a display system, according to an embodiment of the present invention.

FIG. 30 is a top plan view of display surface 650 of connecting module 604A, further illustrating previously described upper surface 660, lower surface 662, and front lip 704.

Figure 31:
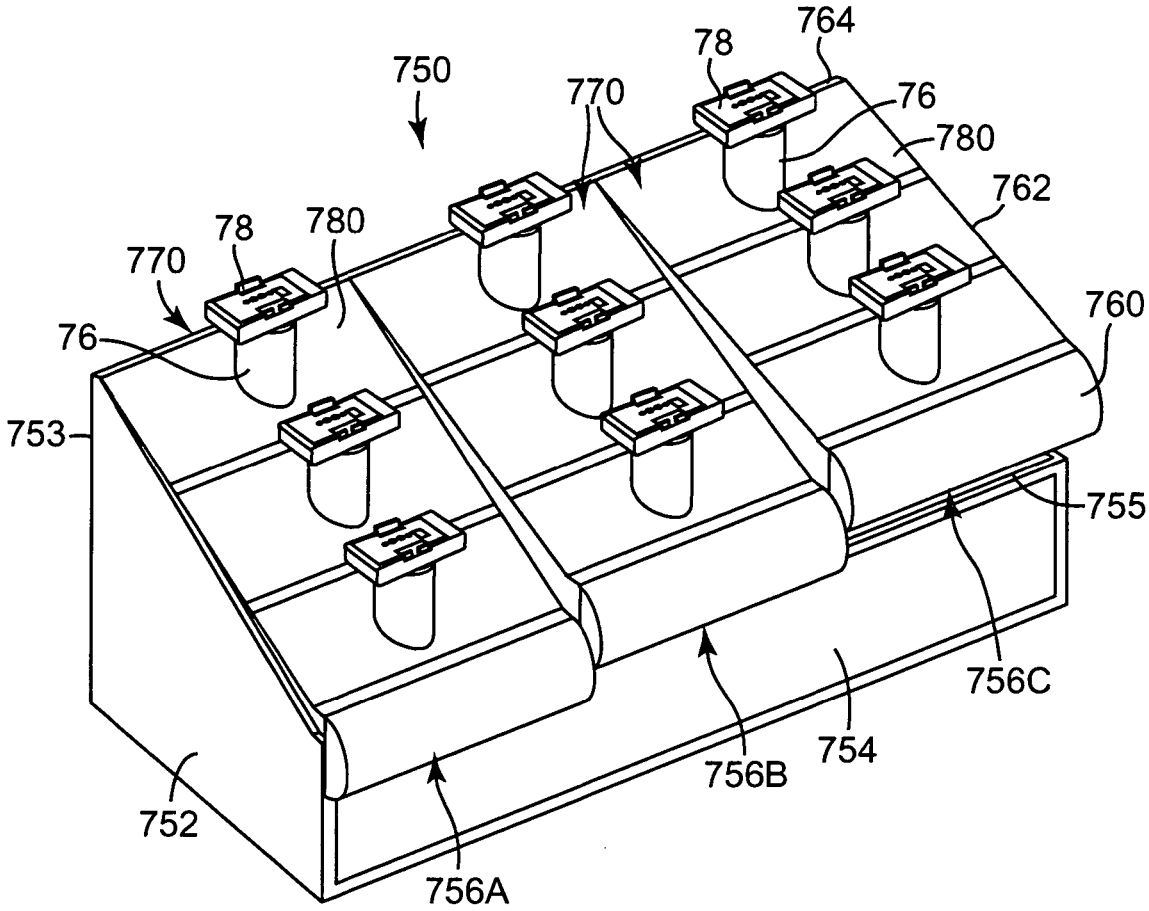
FIG. 31 is an isometric view of a display system, according to an embodiment of the present invention.

FIG. 31 is an isometric view of another embodiment of a display system 750. As shown in FIG. 31, display system 750 comprises base 752 having a rear vertical member 753 and a front vertical member 754 with rear vertical member 753 having a height greater than a height of the front vertical member 754. Lids 756A, 756B, 756C are arranged side-by-side onto base 752 with each lid 756A-756C having first end 760, body 762, and second end 764. Second end 764 of each lid 756A-756C is pivotally mounted to the rear vertical member 753. This pivotal mounting comprises a hinge or other pivoting mechanism joining rear vertical member 753 to second end 764 of each lid 756A-756C, and can comprise a single pivoting mechanism for all three lids, or a separate pivoting mechanism for each lid 756A-756C. First end 760 of each lid 756A-756C is supportable by front vertical member 754. Each lid 756A-756C defines a plurality of electronic device display units 770 having a base surface 780, post 76 and bracket 78 for supporting a consumer device thereon. Device display units 770 are arranged in series between the first end 760 and the second end 764 of each lid 756A-756C along body 762 generally parallel to a longitudinal axis of the lid.

In use, first end 760 of one of lids 756A-756C, such as lid 756C as shown in FIG. 31, is raised off ledge 755 of front vertical member 754 to pivotally raise lid 756C away from base 752 to gain access to an interior of base 752 and/or for manipulation of device display units 770 for reconfiguring device display units within a single lid or between adjacent lids. Accordingly, lid 756A is shown in the closed position while both lids 756B and 756C are shown in a partially opened position.

Figure 32:
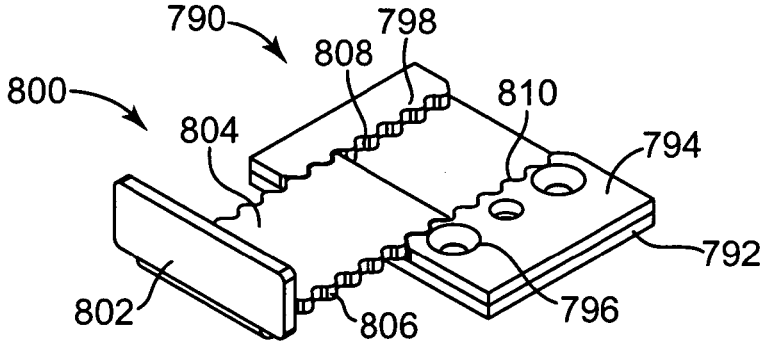
FIG. 32 is an isometric view of a bracket, according to an embodiment of the present invention.

FIG. 32 is an isometric view of an alternative bracket embodiment. Bracket 790 includes base 792, which supports mount 794 having apertures 796, side 798, and slide bracket 800. Slide bracket 800 includes lip 802 and base 804. Base 804 includes a plurality of teeth 806 that interlock with teeth 808 of side 798, and with teeth 810 of mount 794. In use, slide bracket 800 is adjusted to a desired extension relative to side 798 and mount 794, and then a screw, bolt or other fastener is inserted through one or more of apertures 796 and into the camera or other product to be displayed. Tightening the fastener locks bracket 790 into position with respect to the camera or other product, generally preventing or limiting relative rotation between the camera or product and bracket 790.

While specific embodiments have been illustrated and described herein for purposes of description, it will be appreciated by those of ordinary skill in the art that a wide variety of alternate and/or equivalent implementations may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the embodiments discussed herein.

What is claimed is:

1. A method of displaying consumer electronic devices, comprising:

supporting a plurality of rails on a frame in a generally parallel, spaced relationship to each other and configuring each rail for selective slidable movement relative to the frame in a direction generally perpendicular to a longitudinal axis of each rail;

supporting a first row of display units between a first adjacent pair of the plurality of rails;

supporting a second row of display units between a second adjacent pair of the plurality of rails; and reconfiguring the plurality of display units within at least one of the first row of display units and the second row of display units via slidable movement of at least one rail of the plurality of rails relative to the frame to enable insertion and removal of the display units relative to the rails.

2. The method of claim 1 wherein reconfiguring the plurality of display units comprises at least one of:

moving at least one display unit from a first supported position in the first row of display units to a second supported position in the first row of display units, the second supported position being laterally spaced from the first supported position; and moving at least one display unit from the first supported position in the first row of display units to a third supported position in the second row of display units.

3. The method of claim 1 wherein reconfiguring the plurality of display units comprises:

removing at least one display unit from a first supported position in the first row of display units and inserting a second display unit from an external source into the first supported position in the first row of display units.

4. The method of claim 1 wherein slidable movement between the rails and the frame in reconfiguring the plurality of display units comprises at least one of:

increasing a separation distance between the first adjacent pair of rails to enable insertion and removal of the at least one display unit relative to the first adjacent pair of rails; and decreasing the separation distance between the first adjacent pair of rails to enable removably securing the at least one display unit relative to the first adjacent pair of rails.

5. The method of claim 4 wherein increasing the separation distance between the first adjacent pair of rails comprises:

arranging the first adjacent pair of rails as a first rail and a second rail and arranging the second adjacent pair of rails as the second rail and a third rail; and slidably moving the second rail relative to the frame in a first direction away from the first rail and slidably moving the third rail relative to the frame in the first direction away from the second rail.

6. The method of claim 4 wherein decreasing the separation distance between the first adjacent pair of rails comprises:

arranging the first adjacent pair of rails as a first rail and a second rail and arranging the second adjacent pair of rails as the second rail and a third rail; and slidably moving the second rail relative to the frame in a second direction toward the first rail until pressing contact occurs between the first rail, the display unit, and the second rail; and slidably moving the third rail relative to the frame in the second direction toward the second rail until pressing contact occurs between the second rail, the display unit, and the third rail.

7. The method of claim 1 wherein each display unit of the first row and second row of display units comprises a first end and a second end and wherein each rail of the plurality of rails comprises:

an elongate member including a first channel and a second channel with each of the first channel and the second channel extending along a length of the elongate member on opposite sides of the rail, the first channel and the second channel being sized and shaped to slidably receive at least one of the first end and the second end of each display unit.

8. The method of claim 1 wherein supporting a plurality of rails comprises:

defining the frame as a plurality of frame members arranged generally parallel to each other and generally parallel to the plurality of rails, the frame members being spaced from each other to enable each frame member to support one rail of the plurality of rails; and coupling each rail of the plurality of rails relative to a respective frame member via at least one bracket mechanism to enable the limited slidable movement of each rail relative to its respective frame member.

9. The method of claim 1, comprising:

defining each display unit of the first row and second row of display units as at least one of a plate and a device support unit; and arranging the first row of display units as an alternating pattern of the plates and the device support units.

10. A consumer electronic device display system comprising:

a frame configured to support a plurality of rails in a generally parallel relationship along a first direction and in a generally spaced apart relationship relative to each other in a second direction that is generally perpendicular to the first direction, the plurality of rails and the frame being removably coupled to each other to enable limited slidable movement of each rail of the plurality of rails in the second direction relative to the frame;

a first row of display units removably supported between a first adjacent pair of rails of the plurality of rails in a first closed position, the first row extending generally parallel to a longitudinal axis of the rails;

a second row of display units removably supported between a second adjacent pair of rails of the plurality of rails in the first closed position, the second row extending generally parallel to the longitudinal axis of the rails;

wherein slidable movement of at least the first adjacent pair of rails relative to the frame from the first closed position to a second open position, in which the display units of the first row are no longer supported between the first adjacent pair of rails, enables replacement of a first display unit of the first row of display units with a second display unit.

11. The display system of claim 10 wherein the second display unit is obtained from a source external to the first row of display units and the second row of display units.

12. The display system of claim 10 wherein the second display unit is located in the first row of display units and wherein replacement of the first display unit comprises exchanging the first display unit in a first supported position in the first row of display units with the second display unit in a second supported position in the first row of display units, the second supported position being laterally spaced from the first supported position.

13. The display system of claim 10 wherein the second display unit is located in the second row of display units, wherein replacement of the first display unit comprises exchanging the first display unit in a first supported position in the first row of display units with the second display unit in a third supported position in the second row of display units.

14. The display system of claim 10 wherein each display unit in the first row of display units and in the second row of display units comprises at least one of a plate or a device support unit, wherein the device support unit comprises:

a plate defining a body, a first end, and a second end;

a post extending through the body of the plate with a first portion of the post extending above the plate and a second portion extending below the plate; and a support surface fixed to, and generally perpendicular to, the first portion of the post and configured for removably securing a consumer electronic device thereon.

15. The display system of claim 14 wherein the second display unit comprises at least one of the plate and the device support unit.

16. The display system of claim 10 wherein the frame comprises:

a pair of side members arranged generally parallel to each other and spaced apart from each other on opposite sides of the frame;

a plurality of lateral members arranged generally parallel to each other and spaced from each other, extending laterally between and generally perpendicular to the side members, wherein each lateral member of the frame includes a bracket mechanism; and wherein removable coupling of each rail of the plurality of rails relative to each lateral member of the plurality of lateral members via the bracket mechanism enables the slidable movement of each rail relative to the respective lateral members.

17. The display system of claim 10 wherein each rail of the plurality of rails comprises:

an elongate member including a first channel and a second channel with each of the first channel and the second channel extending along a length of the elongate member on opposite sides of the rail, the first channel and the second channel being sized and shaped to slidably receive at least one of a first end and a second end of each display unit.

18. The display system of claim 10 wherein each display unit of the first row and the second row of display units comprises at least one of a plate and a device support unit, and at least one of the first row and the second row of display units are arranged in an alternating pattern of the plates and the device support units.

19. The display system of claim 10 wherein at least one display unit of the first row and the second row of display units comprises a sign unit extending at angle upward relative to the at least one display unit.

* * * * *